US006339041B1

(12) United States Patent
Aono

(10) Patent No.: US 6,339,041 B1
(45) Date of Patent: Jan. 15, 2002

(54) HEAT-SENSITIVE RECORDING MATERIAL

(75) Inventor: Toshiaki Aono, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/415,465

(22) Filed: Oct. 14, 1999

(30) Foreign Application Priority Data

Oct. 19, 1998 (JP) ..... 10-297397

(51) Int. Cl.[7] ..... B41M 5/40
(52) U.S. Cl. ..... 503/226; 503/200
(58) Field of Search ..... 503/200, 207, 503/226

(56) References Cited

U.S. PATENT DOCUMENTS 5,401,708 A 3/1995 Shimizu et al. ..... 503/226
5,679,615 A 10/1997 Matsumoto et al. ..... 503/217
5,866,508 A 2/1999 Sawamura et al. ..... 503/226
6,034,033 A * 3/2000 Aono et al. ..... 503/200

FOREIGN PATENT DOCUMENTS

| | | |
|---|---|---|
| JP | 2-169292 | 6/1990 |
| JP | 3-55289 | 3/1991 |
| JP | 3-193387 | 8/1991 |
| JP | 4-284287 | 10/1992 |

* cited by examiner

*Primary Examiner*—Bruce H. Hess
(74) *Attorney, Agent, or Firm*—Sughrue Mion, PLLC

(57) ABSTRACT

A heat-sensitive recording material, comprising: a support, and a heat-sensitive recording layer and a protective layer which are provided on the support, wherein the protective layer contains at least a silicon denatured polymer and inorganic ultra-fine grains whose mean primary particle diameter is less than or equal to 0.1 $\mu$m.

20 Claims, No Drawings

HEAT-SENSITIVE RECORDING MATERIAL

BACKGROUND OF THE INVENTION

1. Field of the Invention

The present invention relates to a heat-sensitive recording material, and more particularly to a heat-sensitive recording material which comprises a support and a heat-sensitive recording layer and a protective layer which are provided on the support, and which is excellent in transparency, glossiness, and light-fastness, and which is excellent in scratch resistance because the heat-sensitive recording material has a protective layer which is excellent in friction resistance and lubricity with respect to a heat-sensitive recording head so that adhesion of the heat-sensitive recording material to the heat-sensitive recording head or the like and deposition of foreign matters thereon can be prevented.

2. Description of the Related Art

Heat-sensitive recording has been recently developing because the device used for the heat-sensitive recording is structured simply, is highly reliable, and does not need complicated maintenance. As a heat-sensitive recording material, conventionally, compounds obtained through the reaction of an electron donative colorless dye and an electron acceptive compound, and compounds obtained through the reaction of a diazonium salt compound and a coupler are widely known.

In recent years, in order to improve properties including (1) color developing density and color developing sensitivity, (2) fastness of a color developer and the like in heat-sensitive recording materials, extensive studies have been carried out. However, when a heat-sensitive recording material is exposed to sunlight or displayed on walls at offices or the like for a long period of time, there have been drawbacks in that background portions of the material become colored through irradiation of light, and image areas may become discolored or faded. In order to limit the discoloring or fading of image areas, various methods have been proposed. However, these methods fail to provide sufficient results.

On the other hand, in many fields such as facsimiles, printers, labels, and the like, demand for a heat-sensitive recording system is increasing. Accordingly, there is a great demand for a heat-sensitive recording material of higher performance. Image recording of the heat-sensitive recording material is carried out by a heat-sensitive recording head through imagewise heating. In order to print an image on a heat-sensitive recording material in a smooth manner without printing failures and obtain a high quality image which is excellent in glossiness, it is desired to decrease kinetic friction between the heat-sensitive recording material and the heat-sensitive recording head to a certain value or less.

Conventionally, in order to impart friction resistance and lubricity to a heat-sensitive recording material, waxes (e.g., zinc stearic acid or the like), matifying agents, pigments, and the like have been used. However, such means as described above fail to sufficiently provide improvements in friction resistance and lubricity. In addition, if the heat-sensitive recording material is a reflecting material, transparency and glossiness thereof decrease (if the heat-sensitive recording material is a transparent material, the haze degree thereof increases). Further, there have been drawbacks in that these compounds become fused to a heat-sensitive recording head, a printed surface, and the like so that failures such as deposition of foreign matters, unevenness in glossiness, and the like are caused to the heat-sensitive recording material.

SUMMARY OF THE INVENTION

It is an object of the present invention to provide a heat-sensitive recording material which is excellent in transparency, glossiness, and light-fastness and which is excellent in scratch resistance because the heat-sensitive recording material has a protective layer which is excellent in friction resistance and lubricity with respect to a heat-sensitive recording head, thus preventing adhesion of the heat-sensitive recording material to a heat-sensitive recording head or the like and deposition of foreign matters thereon.

In order to accomplish the above-described objects, the present inventors carried out extensive studies, and found that a silicon denatured polymer and inorganic ultra-fine grains having a mean primary particle diameter which is less than or equal to 0.1 μm are added to a protective layer is effective, thus achieving the present invention.

That is, a heat-sensitive recording material according to the present invention comprises a support, and a heat-sensitive recording layer and a protective layer which are provided on the support, wherein the protective layer contains at least a silicon denatured polymer and inorganic ultra-fine grains whose mean primary particle diameter is less than or equal to 0.1 μm. Preferably, this silicon denatured polymer is a silicon graft polymer. Preferably, the inorganic ultra-fine grains are of at least one selected from a group consisted of barium sulfate, zinc oxide, magnesium oxide, lead oxide, zirconium oxide, colloidal silica, or alumina. Among these compounds, colloidal silica, barium sulfate, and alumina are particularly preferable. In cases in which colloidal silica is used, preferably, colloidal silica and inorganic ultra-fine grains of another type mixed in a ratio of 1:9 to 6:4 (colloidal silica to the inorganic ultra-fine grains of another type) by weight are used in combination.

The protective layer can be formed by using in addition another water-soluble binder. As the another water-soluble binder, gelatin is preferable.

DETAILED DESCRIPTION OF THE PREFERRED EMBODIMENTS

A preferred embodiment of a heat-sensitive recording material according to the present invention will be explained hereinafter.

The heat-sensitive recording material of the present invention comprises a support, and a heat sensitive recording layer and a protective layer which are provided on the support. The protective layer contains at least a silicon denatured polymer and inorganic ultra-fine grains having a mean primary particle diameter which is equal to or less than 0.1 μm.

In the present invention, the term inorganic ultra-fine grains refers to grains whose mean primary particle diameter is less than or equal to 0.1 μm. As long as the mean primary particle diameter of inorganic ultra-fine grains is 0.1 μm, there is no other limitations for the inorganic ultra-fine grains. However, preferably, the maximum particle diameter of the ultra-fine grains in a dispersion solution (which is a threshold value of the maximum particle diameter whose particle diameter distribution is larger in the dispersion solution) is equal to or less than 0.5 μm, more preferably, is equal to or less than 0.4 μm, and particularly preferably, is equal to or less than 0.35 μm. The frequency of (aggregated) grains whose particle diameter in the dispersed solution is equal to or more than 0.3 μm is equal to or less than 5%, and preferably, is equal to or less than 1%. Particularly preferably, the frequency of (aggregated) grains whose particle diameter is equal to or more than 0.25 μm is equal to or less than 5%.

Particle diameters of the ultra-fine grains can be measured by a known method, for example, by using a COULTER N4 type sub-micron particle diameter analysis device (manufactured by Nikkaki-sha).

As the inorganic ultra-fine grains of the present invention, inorganic ultra-fine grains such as barium sulfate, zinc oxide, magnesium oxide, lead oxide, zirconium oxide, colloidal silica, or alumina are preferable. Among these compounds, barium sulfate, colloidal silica, and alumina are particularly preferable.

The above-described inorganic ultra-fine grains can be used singly, or two types of these compounds or more can be used in combination. Particularly, since colloidal silica is of high activity, when multiple layers are coated at the same time, due to a combination of layers, one layer may cause unevenness in coating by interacting with a compound of another layer, thus damaging the surface smoothness of the obtained heat-sensitive recording material. Accordingly, in the case in which colloidal silica is used, preferably, colloidal silica and inorganic ultra-fine grain of another type are used in combination. Preferably, colloidal silica and the inorganic ultra-fine grains of another type are mixed and used in combination in a mixture ratio of 1:9 to 6:4 (colloidal silica to the inorganic ultra-fine grains of another type) by weight, and more preferably, 2:8 to 5:5 (colloidal silica to the inorganic ultra-fine grains of another type) by weight. As the combination of colloidal silica and the inorganic ultra-fine grains of another type, preferably, a combination of colloidal silica and barium sulfate is used, and more preferably, colloidal silica and barium sulfate are mixed and used in combination in a mixture ratio of 2:8 to 5:5 (colloidal silica to barium sulfate) by weight.

Examples of the inorganic ultra-fine grains which can be suitably used for the present invention and whose mean primary particle diameter is 0.1 $\mu$m or less are shown in Table 1, and are available as commercial products.

TABLE 1

| Fine Particle Materials | Product Name | Manufacturer |
|---|---|---|
| barium sulfate | BARIFINE BF-21 | Sakai Chemical Industry Co., Ltd. |
| barium sulfate | BARIFINE BF-20 | Sakai Chemical Industry Co., Ltd. |
| zirconium oxide | NZR-A | Nissan Chemical Industries, Ltd. |
| zinc oxide | FINEX-75 | Sakai Chemical Industry Co., Ltd. |
| titanium oxide | TTO-55 | Ishihara Sangyou Kaisha, Ltd. |
| silica | | Nippon Aerogel |

In the present invention, the amount of the inorganic ultra-fine grains added in the protective layer ranges from 0.01 to 1 g/m$^2$, which is 1 to 100% by weight, preferably, 5 to 50% by weight with respect to a binder (containing a silicon denatured polymer). If the amount of the inorganic ultra-fine grains added in the protective layer is less than 0.01 g/m$^2$, effects provided by the inorganic ultra-fine grains added in the protective layer become insufficient. If the amount of the inorganic ultra-fine grains added in the protective layer exceeds 1 g/m$^2$, there are cases in which glossiness of the heat-sensitive recording material decreases.

As a method in which these inorganic ultra-fine grains are mixed with a coating solution for forming the protective layer of the present invention, in order to prevent the ultra-fine grains from becoming aggregated and to thereby achieve uniform sorption of the inorganic ultra-fine grains to surfaces of resin grains, preferably, a method of mixing these inorganic ultra-fine grains with an aqueous dispersed resin such as carboxymethylcellulose, gelatin, or polyvinylalcohol as a resin solution, a method of mixing these inorganic ultra-fine grains with a colloidal dispersion after the colloidal dispersion is prepared by various mills, and the like are adopted from a viewpoint of effects and manufacture of the present invention.

Preferable examples of the silicon denatured polymer include a silicon graft polymer, a silicon block polymer, a silicon denatured acrylic polymer, silicon denatured polyvinyl alcohol, and the like. Preferable examples of the silicon graft polymer include a silicon graft acrylic polymer and a silicon graft denatured polyvinyl alcohol. Preferable examples of the silicon block polymer include a silicon block acrylic polymer and silicon block denatured polyvinyl alcohol.

As the characteristics of a backbone polymer of the silicon denatured polymer, any resin which is excellent in film-forming ability, heat resistance, light-fastness, and coating strength and which has a high Tg (glass transition point) can be used. Acrylic resin and polyvinyl alcoholic resin are particularly preferably used.

Examples of monomers for forming such acrylic resins include acrylic monomers such as (metha) acrylic acid methyl, methacrylic acid butyl, (metha) acrylic acid-2-ethylhexyl, and (metha) acrylic acid glycidyl. Monomers which are not acrylic monomers and which can be copolymerized, such as styrene, acrylonitol, vinyl acetate, N-vinylpyrolidone, N-t-butylacrylic amide can be copolymerized. Further, if monomers are of a water-soluble type, as a water-solubility imparting unit, or if monomers are of an emulsion type or a latex type, as a dispersion stability imparting unit, preferably, monomers such as (metha) acrylic acid (or its salt), maleic acid (or its salt), itaconic acid (or its salt), styrene sulfonic acid (or its salt), 2-acrylic amide-2-methylpropanesulfonic acid (or its salt), 2-hydroxyethyl (metha) acrylate, acrylic amide, dimethylacrylic amide, dimethylaminoethyl (metha) acrylate (or its salt), and polyethyleneglycolmonomethylethermono (metha) acrylate are preferably contained.

Any type of silicon can be used as a branch polymer of the silicon denatured polymer. However, preferably, polydimethylsiloxane is used. Polydimethylsiloxane has excellent characteristics in terms of water-repellency and lubricity.

Accordingly, copolymers having units resulting from the aforementioned acrylic monomers and polydimethylsiloxane units are excellent in film-forming ability, heat resistance, light-fastness, and film coating strength, and are excellent in water-repellency and lubricity as well.

As the silicon denatured polymer of the present invention, preferably, a silicon graft polymer is used. However, among these silicon graft polymers, a copolymer of silicon macro monomers represented by formula (1) and a monomer capable of being copolymerized with these silicon macro monomers is preferable; among these copolymers, a copolymer represented by formula (2) is particularly preferable.

FORMULA (1)

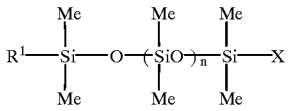

$R^1$: ALKYL GROUP HAVING 1 TO 6 CARBON ATOMS

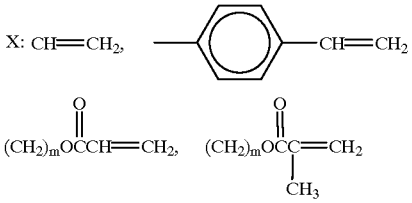

m: 2 to 6
n: POSITIVE INTEGER

FORMULA (2)

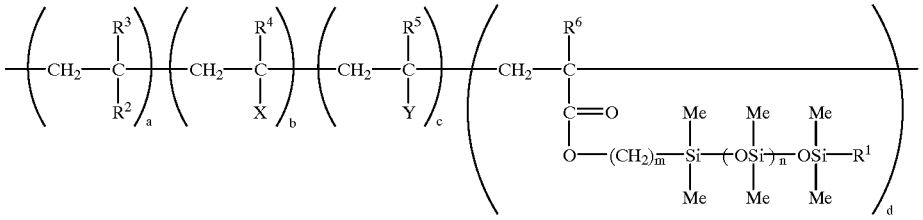

wherein $R^1$ represents an alkyl group having 1 to 6 carbon atoms, $R^2$ represents —$COOR^7$, an aryl group, a cyano group, an imidazole group, a triazole group, a pyrolidone group, —$OCOR^7$ ($R^7$ represents an alkyl group, an aryl group, or an aralkyl group), each of $R^3$, $R^4$, $R^5$, and $R^6$ represents a hydrogen or a methyl group, X represents a hydrophilic group, Y represents a reactive group, n represents a positive integer, m represents 2 to 6, and each of a, b, C, and d (here, c may be zero) represents a polymerization degree.

In the formula (2), examples of hydrophilic group (X) include a polyethylene oxide group, a polypropylene oxide group, a carboxy (or its salt) group, a hydroxy group, a sulfonic acid (or its salt) group, an amino group, an amide group, a substituted amide group, an ammonium salt group, and a group having functional groups of these (e.g., —$COOCH_2CH_2OH$, —$COO(CH_2CH_2O)nH$), and the like.

Examples of the reactive group (Y) include groups which are able to react with a crosslinking agent and/or a binder, such as an amino group, a carboxy (or its salt) group, a hydroxy group, a sulfinic acid (or its salt) group, a glycidyl group and a group having functional groups of these, and the like.

In accordance with a mixing composition of monomers, these silicon graft acrylic polymers are prepared by solution-polymerizing monomers in an organic solvent such as isopropyl alcohol, toluene, xylene, or the like by using an azobis-compound or an organic peroxide, or by emulsion-polymerizing monomers in the presence of nonionic, anionic, and cationic surfactants by using potassium persulfate.

Silicon denatured polyvinyl alcohol derivatives are polymers having repeated units (a polysiloxane chain) represented by formula (3) and formula (4).

Formula (3)

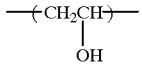

Formula (4)

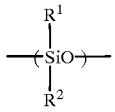

In the formula (4), each of $R^1$ and $R^2$ represents an alkyl group or an aryl group having 6 carbon atoms or less.

Examples of substituents of a polysiloxane chain include a methyl group, an ethyl group, a phenyl group, and the like. However, from a viewpoint of availability of raw materials, polymethylsiloxane is particularly suitable.

Conventionally, polyvinyl alcohol derivatives containing silicon are well known. Examples of polyvinyl alcohol derivatives containing silicon are disclosed in Japanese Patent Application Laid-Open (JP-A) Nos. 63-196603, 58-79003, and 58-59203. Further, methods in which such a compound is used in or on a heat-sensitive color-developing layer of a heat-sensitive recording material are described in JP-A Nos. 58-193189, 1-204785, and 2-22646, and Japanese Patent Application Publication (JP-B) No. 4-32745. However, a description of such compounds as disclosed in these applications has been made only about those in which silicon contains a reactive substituent such as an alkoxy group, an asiloxy group, a hydroxyl group (or alkali metal salt), or the like. A description of polyvinyl alcohol derivatives having a polysiloxane chain has not been made.

As an example of synthesizing the polyvinyl alcohol derivatives containing a polysiloxane chain, there is a method in which polyvinyl alcohol derivatives having polydimethylsiloxane are synthesized by hydrolyzing a copolymer of a polydimethylsiloxane having a vinyl group and a vinyl acetate has been described in Makromol, Chem. 186 (4) 685 (1985), J. Colloid. Interface, Sci. 114 (1) 16 (1986), a high polymer processing 34 (11) 522 (1985), and the like. However, in these descriptions, a description of application of these methods to a heat-sensitive recording material has not been made.

An example of synthesizing the polyvinyl alcohol derivatives through the reaction of polysiloxane containing an isocyanate group and a resin containing an active hydrogen is disclosed in JP-A No. 63-256629. Further, an example of synthesizing the polyvinyl alcohol derivatives through the reaction of polysiloxane containing an epoxy group and polyvinyl alcohol is disclosed in JP-A No. 7-292361. However, a description of application of these examples to a heat-sensitive recording material has not been made.

A method in which a copolymer of a monomer having a polysiloxane chain and a vinyl acetate is hydrolyzed, and a method in which a polysiloxane compound containing reactive functional groups such as an epoxy group and an isocyanate group, a carboxylic acid, a carboxylic acid halide, and the like, and a hydroxyl group (or a COOH group which can be contained in polyvinyl alcohol as a copolymer compound, or the like) of polyvinyl alcohol (or its derivatives) are made to react with each other are used. As a result, it is possible to obtain silicon graft polyvinyl alcohol (or its derivatives) having a polysiloxane chain as a graft chain.

The silicon block polyvinyl alcohol (or its derivatives) can be obtained by radically polymerizing a monomer containing a polysiloxane chain from a terminal SH group of polyvinyl alcohol derivatives having an SH group at the terminal thereof. Such a method in which a block polymer is composed through a radical polymerization using a terminal SH group is disclosed in JP-A No. 59-189133, and collection of high polymers 49 (11) 885 (1992), or the like. However, a description of examples of sunthesizing silicon block polyvinyl alcohol derivatives by using a monomer containing polysiloxane has not been made. Further, silicon block polyvinyl alcohol (its derivatives) can be obtained through addition of a polysiloxane compound containing an epoxy group to a terminal SH group of polyvinyl alcohol derivatives having an SH group at the terminal thereof.

As a monomer which contains a polysiloxane chain used for these synthesis examples, a compound represented by the above-described formula (1) can be listed.

The silicon denatured polymer of the present invention may be any of a water-soluble type, an emulsion type, a latex type, a type in which the silicon denatured polymer is dissolved in solvents such as alcohol miscible with water, or a type in which, during a preparation of a coating solution or before the preparation of the coating solution, these solvents are taken away from a type in which a silicon denatured polymer is dissolved in the mixed solvent of these solvents and water. However, the following are preferable: the water-soluble type, the type in which a silicon denatured polymer is dissolved in solvents such as alcohol miscible with water, or the type in which, during a preparation of a coating solution or before the preparation of the coating solution, these solvents are taken away from the type in which the silicon denatured polymer is dissolved in the mixed solvent of these solvents and water.

As Tg (glass transition point) of these silicon denatured polymers, 60° C. or more is preferable, 80° C. or more is more preferable, and 100° C. or more is particularly preferable. If Tg of the silicon denatured polymer is less than 60° C., smoothness between the heat-sensitive recording material and the heat-sensitive recording head during printing deteriorates, which is not preferable.

Preferably, the binder of the protective layer of the heat-sensitive recording material of the present invention contains a silicon denatured polymer in an amount of from 5 to 100% by weight, and more preferably, in an amount of from 50 to 90% by weight. If the amount of a silicon denatured polymer contained in the binder is less than 5% by weight, the above-described characteristics through the use of the silicon denatured polymer cannot be sufficiently obtained.

In the protective layer, other than the silicon denatured polymer, another water-soluble binder compound can be used in combination as needed. Examples of the another water-soluble binder include methyl cellulose, carboxymethylcellulose, hydroxyethylcellulose, starches, agar-agar, κ-carageenan, gelatin, gum arabic, casein, styrene-maleic anhydride copolymer hydrolysate, ethylene-maleic anhydride copolymer hydrolysate, isobutylene-maleic anhydride copolymer hydrolysate, polyvinyl alcohol, denatured polyvinyl alcohol, polyacrylamide, and the like.

Among these high polymers, a water-soluble polymer which can be set and dried is suitably used in view of the point that it can provide a high surface smoothness on a ground surface portion and a printed surface of the heat-sensitive recording material, and it is excellent in glossiness. The water-soluble polymer which can be set and dried refers to a water-soluble polymer which exhibits a predetermined viscosity when heated (at the temperature of about 40° C.) thus allowing the water-soluble polymer to be coated on the heat-sensitive recording material, and thereafter, increases in viscosity when cooled (at a temperature between 5° C. and 15° C.), terminates the state of liquidity, and is thereby gelled.

In the present invention, examples of suitable water-soluble binders in terms of being able to be set and dried include: protein such as gelatin; carageenan; polysaccharide such as agar-agar; a polyvinylalcohol-based compound, and the like. Gelatin is particularly preferable in terms of being excellent in its compatibility with a silicon denatured polymer. When gelatin and a silicon denatured polymer are used, preferably, the ratio of the silicon denatured polymer to the gelatin ranges from 50:50 to 90:10 by weight.

In the case of the polyvinyl alcohol compound, in terms of having a good compatibility with the silicon denatured polymer, silanol denatured polyvinyl alcohol is preferably used. Further, the silanol denatured polyvinyl alcohol can be used in combination with a boric acid as a gelatinizer or its salt, as a water-soluble polymer which can be set and dried. When the silanol denatured polyvinyl alcohol and the silicon denatured polymer are used, preferably, the ratio of the silanol denatured polyvinyl alcohol to the silicon denatured polymer ranges from 5:95 to 95:5, and more preferably, from 50:50 to 90:10.

In the present invention, it is difficult to set and dry the silicon denatured polymer by itself. Formation of the protective layer can be facilitated by using the silicon denatured polymer in combination with the aforementioned water-soluble polymer which can be set and dried. In the case of the protective layer formed by such a method as described above, a silicon denatured polymer having a relatively high Tg (glass transition point) can easily be oriented in the vicinity of the surface of the protective layer. Since hardness on the surface side of the protective layer is high, adhesion of a heat-sensitive recording head or the like to the obverse surface of the protective layer and deposition of foreign matters thereon can be prevented. And effects of smoothing processing are imparted to the obverse surface of the protective layer through the use of the heat-sensitive recording head or the like. Accordingly, the heat-sensitive recording head or the like becomes excellent in its tracking ability so that the heat-sensitive recording material can be free from printing failures and have increased color-developing density.

As the another water-soluble binder, a synthetic rubber latex, a synthetic resin emulsion, or the like can be used. Examples of monomers for forming latexes and emulsions of these polymers include acrylic acid ester, methacrylic acid ester, crotonic acid ester, vinyl ester, maleic acid diester, fumaric acid diester, itaconic acid diester, acryl amides, methacryl amides, vinyl ethers, styrenes, acrylonitrile, and the like.

Further, specific examples of acrylic acid ester which may be used for these monomers include methylacrylate, ethylacrylate, n-propylacrylate, isopropylacrylate, n-butylacrylate, isobutylacrylate, tert-butylacrylate, hexylacrylate, 2-ethylhexylacrylate, acetoxyethylacrylate, phenylacrylate, 2-methoxyacrylate, 2-ethoxyacrylate, 2-(2-methoxyethoxy) ethylacrylate, and the like.

Specific examples of methacrylic acid ester include methylmethacrylate, ethylmethacrylate, n-propylmethacrylate, n-butylmethacrylate, tert-butylmethacrylate, cyclohexylmethacrylate, 2-hydroxyethylmethacrylate, 2-etoxyethylmethacrylate, and the like.

Specific examples of crotonic acid ester include crotonic acid butyl, crotonic acid hexyl, and the like. Specific examples of vinyl ester include vinyl acetate, vinylpropionate, vinyl butylate, vinylmethoxyacetate, benzonic acid vinyl, and the like.

Specific examples of maleic acid diester include maleic acid diethyl, maleic acid dimethyl, maleic acid dibutyl, and the like. Specific examples of fumaric acid diester include fumaric acid diethyl, fumaric acid dimethyl, fumaric acid dibutyl, and the like. Special examples of itaconic acid diethyl include itaconic acid diethyl, itaconic acid dimethyl, itaconic acid dibutyl, and the like.

Specific examples of acrylamides include acrylamide, methylacrylamide, ethylacrylamide, propylacrylamide, n-butylacrylamide, tert-butylacrylamide, cyclohexylacrylamide, 2-methoxyethylacrylamide, cyclohexylacrylamide, 2-methoxyethylacrylamide, dimethylacrylamide, diethylacrylamide, phenylacrylamide, and the like.

Specific examples of methacrylamides include methacrylamide, ethylmethacrylamide, n-butylmethacrylamide, tert-butylmethacrylamide, 2-methoxymethacrylamide, dimethylmethacrylamide, diethylmethacrylamide, and the like.

Specific examples of vinyl ethers include methylvinylether, butylvinylether, hexylvinylether, methoxyethylvinylether, dimethylaminovinylether, and the like. Specific examples of styrenes include styrene, methylstyrene, dimethylstyrene, trimethylstyrene, ethylstyrene, isopropylstyrene, butylstyrene, chloromethylstyrene, methoxystyrene, butoxystyrene, acetoxystyrene, chlorostyrene, dichlorostyrene, bromostyrene, vinyl benzonic methylester, 2-methylstyrene, and the like.

A polymer formed by these monomers may be a homopolymer or a copolymer. Preferably, acrylic acid esters, methacrylic acid ester, styrenes, acrylic acids, a binary or ternary copolymer of methacrylic acid, and a copolymer of styrenes and butadiens are used.

$T_g$ (glass transition point) of a high polymer for structuring a water-soluble binder is equal to or less than 150° C., preferably, ranges from 0° C. to 130° C., and more preferably, ranges from 40° C. to 100° C.

It is desired that a crosslinking agent which reacts with the silicon denatured polymer and/or the water-soluble binder through the crosslinking reaction is used in combination. It is also desired that the silicon denatured polymer and/or the water-soluble binder has at least one functional group which is chosen from a carboxy group, an amino group, an ammonium salt group, a hydroxy group, a sulfinic acid (or its salt) group, a sulfonic acid (or its salt) group, and a glycidyl group.

As the aforementioned crosslinking agents, a vinyl sulfone-based compound, an aldehyde-based compound (formaldehyde, glutaraldehyde, and the like), an epoxy-based compound, an oxazine-based compound, a triazine-based compound, a high polymer hardening agent disclosed in JP-A No. 62-234157, a methylated melamine, a blocked isocyanate, a methylol compound, a carbodiimide resin, and the like can be used.

Among these crosslinking agents, the vinyl sulfone-based compound, the aldehyde-based compound, the epoxide-based compound, the oxazine-based compound, the triazine-based compound, and the high polymer hardening agent disclosed in JP-A No. 62-234157 are particularly suitable.

Among denatured polyvinyl alcohol, silanol denatured polyvinyl alcohol is particularly preferable and is able to improve water resistance or the like by itself. However, in order to further improve water resistance, it is effective to use a crosslinking agent and a catalyst which promotes a crosslinking reaction of the crosslinking agent are used in combination with the silanol denatured polyvinyl alcohol.

Specific examples of crosslinking agents are described as below.

As epoxy compounds, a compound having two functional groups or more can be used. Examples of these epoxy compounds include dibromophenyl glycidyl ether, dibromoneopentyl glycol diglycidyl ether, an emulsion of an epoxy crezol novolak resin, a denatured bisphenol A-type epoxy emulsion, adipic acid diglycidyl ester, o-phthalate diglycidyl ester, hydroquinone diglycidyl ether, bisphenol S glycidyl ether, telephthalate diglycidyl ether, glycidyl phthalimide, propylene polypropylene glycol diglycidyl ether, polytetramethylene glycol diglycidyl ether, arylglycidyl ether, 2-ethylhexylglycidyl ether, phenylglycidyl ether, phenol (EO) 5 glycidyl ether, p-tertiary butylphenylglycidyl ether, lauryl alcohol (EO) 15 glycidyl ether, glycidyl ether formed by an alcohol mixture having 12 to 13 carbon atoms, glycerol polyglycidyl ether, trimethylolpropanepolyglycidyl ether, resorcinol diglycidyl ether, neopentylglycoldiglycidyl ether, 1,6-hexandiolediglycidyl ether, ethylene polyethylene glycol diglycidyl ether, sorbitolpolyglycidyl ether, sorbitan polyglycidyl ether, polyglycerol polyglycidyl ether, pentaerythritol polyglycidyl ether, diglycerol polyglycidyl ether, triglycidyl-tris (2-hydroxyethyl) isocyanurate, and the like. Among these, glycidyl ethers are particularly suitable.

It is desired that an effective epoxy equivalent of the epoxy compound for the present invention ranges from 70 to 1,000 WPE. When the epoxy equivalent is more than 1,000 WPE, it becomes difficult to confer water resistance to the heat-sensitive recording material of the present invention, which is not preferable.

Blocked isocyanate refers to a compound in which a terminal isocyanate group of isocyanate is masked by a blocking agent. Examples of blocked isocyanate include: (a) a compound in which a blocking body of a hydrophilic group which is comprised of a carbamoil sulfonate group ($—NHCOSO^{3-}$) is formed at the terminal end of an isocyanate compound so that an active isocyanate group is blocked, (b) a compound in which an active isocyanate group is blocked by using isopropyliden malonate (this blocked isocyanate is obtained through the reaction between HDI isocyanulate, isopropylidenmalonate, and triethylamine), (c) a compound in which an active isocyanate group is blocked by phenols, and the like. Such blocked isocyanate as described above is mixed with ethylene denatured polyvinyl alcohol, and heated so that the quality of ethylene denatured polyvinyl alcohol improves through a crosslinking, thereby achieving water resistance for the ethylene denatured polyvinyl alcohol.

Vinyl sulfonate compounds disclosed in JP-A Nos. 53-57257 and 53-41221, Japanese Patent Application Publication (JP-B) Nos. 49-13563 and 47-24259, and the like can be used.

Examples of aldehyde-based compounds include monoaldehyde such as formaldehyde and acetoaldehyde, and polyhydelic aldehyde such as glyoxal, glutaraldehyde, and dialdehyde starch. Examples of methylol compounds include methylolmelamine, dimethylol carbamide, and the like. In the case of the silanol denatured polyvinyl alcohol, the aldehyde-based compound is particularly suitable as a crosslinking agent.

It is desired that the amount of a crosslinking agent used for the above-mentioned water-soluble polymer, polymer latex, or polymer emulsion ranges from 1 to 50 parts by weight with respect to a water-soluble polymer, a polymer latex, or a polymer emulsion in an amount of 100 parts by weight. If the amount of a mixture of the crosslinking agent is less than 1 part by weight, the degree of quality improvement through the reaction of crosslinking is low so that the crosslinking agent cannot provide sufficient water resistance, chemical resistance, and the like. Meanwhile, if the amount of the mixture of the cross-linking agent is more than 50 parts by weight, liquid stability deteriorates, which is not preferable.

The heat-sensitive recording layer of the present invention may be a full color heat-sensitive recording layer, or a mono color heat-sensitive recording layer. However, it is preferable for the heat-sensitive recording layer to comprise at least a heat-sensitive recording layer which is provided on a support, and which comprises a diazo compound, a coupler which reacts with the diazo compound, and a binder, as main components. Particularly preferably, the heat-sensitive recording layer has a heat-recording sensitive layer formed by a diazo compound, together with cyan, yellow, and magenta.

A heat-sensitive recording material in which a transparent heat-sensitive recording layer is coated on a transparent support is preferable to obtain effects of the present invention. In the case of a full color heat-sensitive recording layer, a heat-sensitive recording material which comprises a light-fixation type heat-sensitive recording layer which is provided on a support, a light transmittance adjusting layer in which light transmittance having a wavelength range within which images are fixed to the light-fixation type heat-sensitive recording layer decreases after fixation of the images, and a protective layer which is provided on these layers.

Preferably, the light-fixation type heat-sensitive recording layer comprises a heat-sensitive recording layer which contains a diazonium salt compound having a maximum absorption wavelength of 360±20 nm and a coupler which reacts with the diazonium salt compound to thereby develop color, and a light-fixation type heat-sensitive recording layer which contains a diazonium salt compound having a maximum absorption wavelength of 400±20 nm and a coupler which reacts with the diazonium salt compound to thereby develop color.

Preferably, the heat-sensitive recording material comprises a heat-sensitive recording layer which is provided on the support and contains an electron donative dye and an electron acceptive compound, a light-fixation type heat-sensitive recording layer which contains a diazonium salt compound having a maximum absorption wavelength of 400±20 nm and a coupler which reacts with the diazonium salt compound to thereby develop color, a light-fixation type heat-sensitive recording layer which contains a diazonium salt compound having a maximum absorption wavelength of 360±20 nm and a coupler which reacts with the diazonium salt compound to thereby develop color, and a light transmittance adjusting layer and a protective layer, which are provided on these layers.

Also preferably, the heat-sensitive recording material comprises a light-fixation type heat-sensitive recording layer which is provided on the support and contains a diazonium salt compound having a maximum absorption wavelength of 340±20 nm or less and a coupler which reacts with the diazonium salt compound to thereby develop color, a light-fixation type heat-sensitive recording layer which contains a diazonium salt compound having a maximum absorption wavelength of 360±20 nm and a coupler which reacts with the diazonium salt compound to thereby develop color, and a light-fixation type heat-sensitive recording layer which contains a diazonium salt compound having a maximum absorption wavelength of 400±20 nm and a coupler which reacts with the diazonium salt compound to thereby develop color, and a light transmittance adjusting layer and a protective layer, which are provided on these layers.

The light transmittance adjusting layer contains therein a compound which acts as a precursor of a UV absorbent. Since the precursor does not act as a UV absorbent before the light transmittance adjusting layer is irradiated with light having the necessary wavelength range to fix an image, light transmittance through the layer is high. When images are fixed to the light-fixation type heat-sensitive recording layer, light having the necessary wavelength range to fix images thereto is sufficiently transmitted through the layer. The transmittance of visible light through this layer is high so that images can be successfully fixed to the heat-sensitive recording layer.

After the light-fixation type heat-sensitive recording layer has been irradiated with light having the necessary wavelength range to fix images thereto, the precursor of a UV absorbent acts as a UV absorbent by a reaction to light or heat. Most of the light having the necessary wavelength range to fix images to a UV region is absorbed by the UV absorbent. Accordingly, the transmittance in the UV region decreases, while the light-fastness of the heat-sensitive recording material increases. However, since the precursor of the UV absorbent cannot absorb visible light, the transmittance of visible light remains as it is.

At least one light transmittance adjusting layer can be provided in the light-fixation type heat-sensitive recording material. It is most preferable to form the light transmittance adjusting layer between the light-fixation heat-sensitive recording layer and the outermost protective layer. However, the light transmittance adjusting layer can be used as the protective layer. Properties of the light transmittance adjusting layer can be selected at will in accordance with the properties of the light-fixation type heat-sensitive recording layer.

Particularly, the present invention is effectively applicable to a heat-sensitive recording material that preferably comprises: a light-fixation type heat-sensitive recording layer which is provided on a support and contains a diazonium salt compound having a maximum absorption wavelength of 360±20 nm and a coupler which reacts with the diazonium salt compound to thereby develop color, a light-fixation heat-sensitive recording layer which contains a diazonium salt compound having a maximum absorption wavelength of 400±20 nm and a coupler which reacts with the diazonium salt compound to thereby develop color, and a light transmittance adjusting layer which is provided on these layers. In the case of the above-described heat-sensitive recording material, the transmittance of light to the light transmittance adjusting layer in a wavelength range for fixing images is preferably greater than or equal to 65% at 360 nm. After images have been fixed, the transmittance of light to the light transmittance adjusting layer is preferably less than or equal to 20% at 360 nm. In this case, "light irradiation" means that light having a wavelength of 420 nm is irradiated using a xenon lamp apparatus in an amount of 13 kJ/m$^2$. More specifically, light is irradiated by a Weather Ometer Ci65 (manufactured by Atlas Electric Co., Ltd.) in an amount of 0.9 W/m$^2$ for 4.0 hours.

The present invention is also applied to a case in which the heat-sensitive recording material comprises a light-fixation type heat-sensitive recording layer which contains a diazonium salt compound having a maximum absorption wavelength which is less than 340 nm and a coupler which reacts with the diazonium salt compound to thereby develop color, and a light-fixation type heat-sensitive recording layer which contains a diazonium salt compound having a maximum absorption wavelength which is more than 420 nm and a coupler which reacts with the diazonium salt compound to thereby develop color.

A multicolor heat-sensitive recording material is obtained by making the hue of each of the heat-sensitive recording layers different in a heat-sensitive recording layer. Namely, the hue to be developed in each multicolor heat-sensitive recording layer may be selected so as to be one of three primary colors in a subtractive color process, i.e., yellow, magenta, and cyan, thereby enabling an image to be recorded in full color. In this case, the color-developing mechanism of the heat-sensitive recording layer which is provided directly on the surface of the support (the lowest layer of the heat-sensitive recording layer) can use any of a color-developing type which comprises an electron donative dye and an electron acceptive dye, a diazo color-developing type which contains a diazonium salt and a coupler which reacts with the diazonium salt to thereby develop color, a base color-developing type which develops color by contacting a basic compound, a chelate color developing type, and a color developing type which reacts with a nucleophile, causing an elimination reaction to thereby develop color. However, a diazo color developing type is preferable. This heat-sensitive recording layer preferably comprises thereon two light-fixation type heat-sensitive recording layers which respectively contain different diazonium salt compounds having different maximum absorption wavelengths and corresponding couplers which react with the diazonium salt compounds to thereby develop color, and sequentially, a light transmittance adjusting layer and an outermost protective layer which are provided on these layers.

In the present invention, a compound which is described in JP-A No. 9-1928 can be used as the compound to be contained in the light transmittance adjusting layer.

The present invention uses conventionally known color-developing components as color-developing components used in the heat-sensitive recording layer. More preferably, the present invention uses compounds formed through the reaction of a diazonium salt compound and a coupler, or the reaction of an electron donative dye and an electron acceptive compound. Compounds used for the heat-sensitive recording layer which contains diazonium salt compounds and couplers which react with the diazonium salt compounds by heating to develop color include: diazonium salt compounds; couplers which react with the diazonium salt compounds to form dyes; and basic substances which promote the reaction of the diazonium salt compounds and couplers.

The diazonium salt compounds are those described below which are capable of controlling a maximum absorption wavelength due to the position or types of substituents of the Ar portion.

$$Ar—N_2^+.X^-$$

wherein Ar represents an aryl group, and $X^-$ represents an acid anion. Specific examples of the diazonium salt compounds in the present invention include: acid anion salts such as 4-(N-(2-(2,4-di-tert-amylphenoxy) butyryl) piperazino) benzenediazonium, 4-dioctylaminobenzenediazonium, 4-(N-(2-ethylhexanoyl) piperazino) benzenediazonium, 4-dihexylamino-2-hexyloxybenzenediazonium, 4-N-ethyl-N-hexadecylamino-2-ethoxybenzodiazonium, 3-chloro-4-dioctylamino-2-octyloxyobenzenediazonium, 2,5-dibutoxy-4-morphorinobenzenediazonium, 2,5-octoxy-4-morphorinobenzenediazonium, 2,5-dibutoxy-4-(N-(2-ethylhexanoyl)piperazino)benzenediazonium, 2,5-diethoxy-4-(N-(2-(2,4-di-tert-aminophenoxy)butyryl)piperazino) benzenediazonium, 2,5-dibuthoxy-4-tolylthiobenzene diazonium, 3-(2-octyloxyethoxy)-4-morphorinobenzenediazonium and the like, and the below listed diazonium salt compounds D-1 to D-5. As the diazonium compounds, particularly preferable are hexafluorophosphate salts, tetrafluoroborate salts, and 1,5-naphthalenesulfonate salts.

D-1

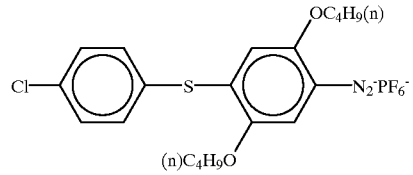

D-2

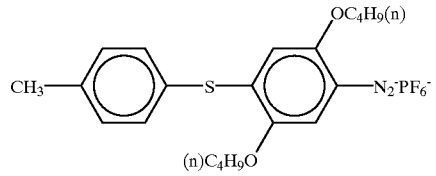

D-3

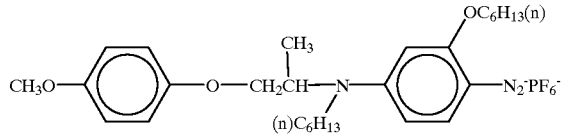

-continued

D-4

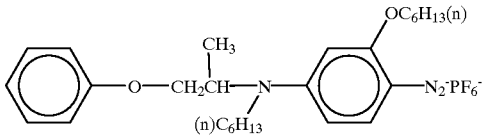

D-5

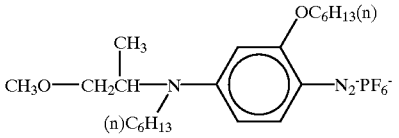

Among these diazonium salt compounds, particularly preferable compounds of the present invention which are photodecomposed by light having a wavelength of 300 to 400 nm include: 4-(N-(2-(2,4-di-tert-amylphenoxy)butyryl) piperazino) benzenediazonium, 4-dioctylaminobenzenediazonium, 4-(N-(2-ethylhexanoyl) piperazino)benzenediazonium, 4-dihexylamino-2-hexyloxybenzenediazonium, 4-N-ethyl-N-hexadecylamino-2-ethoxybenzodiazonium, 2,5-dibutoxy-4-(N-(2-ethylhexanoyl)piperazino)benzenediazonium, 2,5-diethoxy-4-(N-(2-(2,4-di-tert-amylphenoxy)butyryl)piperazino) benzenediazonium or the compounds described in the aforementioned specific examples D-3 to D-5.

The maximum absorption wavelength of these diazonium salt compounds is determined by measuring each of the compounds formed into a coating film having a thickness of 0.1 g/m$^2$ to 1.0 g/m$^2$ with a spectrophotometer (Shimazu MPS-2000).

Couplers, which are used in the present invention and react with the aforementioned diazonium salts by heating so as to develop color, include: resorcin, phloroglucin, sodium 2,3-dihydroxynaphthalene-6-sulfonate, 1-hydroxy-2-naphthoic acid morpholinopropylamide, 1,5-dihydroxynaphthalene, 2,3-dihydroxynaphthalene, 2,3-dihydroxy-6-sulfanyl-naphthalene, 2-hydroxy-3-naphthoic acid anilide, 2-hydroxy-3-naphthoic acid ethanolamide, 2-hydroxy-3-naphthoic acid octylamide, 2-hydroxy-3-naphthoic acid-N-dodecyloxypropylamide, 2-hydroxy-3-naphthoic acid tetradecylamide, acetanilide, acetoacetanilide, benzoylacetanilide, 2-chloro-5-octylacetoacetanilide, 1-phenyl-3-methyl-5-pyrazolone, 1-(2',octylphenyl)-3-methyl-5-pyrazolone, 1-(2',4',6'-trichlorophenyl)-3-benzamide-5-pyrazolone, 1-(2',4',6'-trichlorophenyl)-3-anilino-5-pyralone, 1-phenyl-3-phenylacetamide-5-pyrazolone, and the below-listed compounds C-1 to C-6. Two or more of these couplers can be mixed to obtain the desired color-developing hue.

C-1

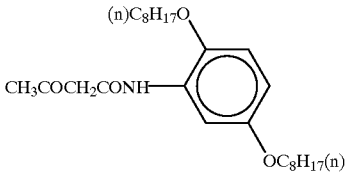

-continued

C-2

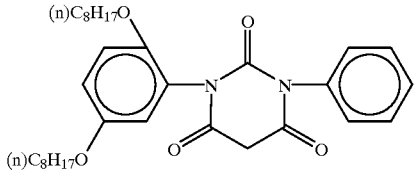

C-3

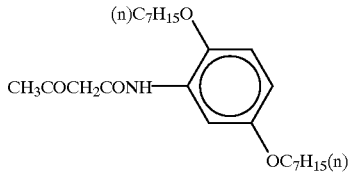

C-4

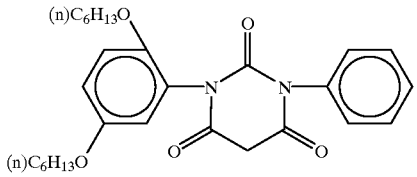

C-5

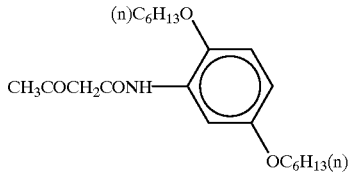

C-6

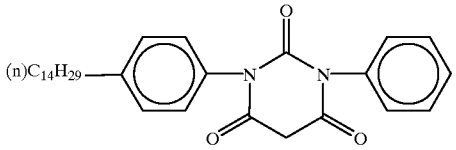

In addition to inorganic or organic basic compounds, basic substances include compounds which decompose or the like and discharge alkali substances when heated. Typical examples of these compounds include: nitrogen-containing compounds such as organic ammonium salts, organic amine, amide, urea and thiourea, and derivatives thereof, and thiazoles, pyrrols, pyrimidines, piperazines, guanizines, indoles, imidazoles, imidazolines, triazoles, morpholines, pyperidines, amidines, formazines, pyridines and the like. Specific examples of these compounds include tricyclohexylamine, tribenzylamine, octadecylbenzylamine, stearylamine, aryl urea, thiourea, methyl thiourea, aryl thiourea, ethylene thiourea, 2-benzylimidazole, 4-phenylimidazole, 2-phenyl-4-methylimidazole, 2-undecylimidazoline, 2,4,5-trifuryl-2-imidazoline, 1,2-diphenyl-4,4-dimethyl-2-imidazoline, 2-phenyl-2-imidazoline, 1,2,3-triphenylguanidine, 1,2-dicyclohexylguanidine, 1,2,3-tricyclohexylguanidine, guanidinetrichloroacetate, N,N'-dibenzylpiperadine, 4,4'-dithiomorpholine, morpholiniumtrichloroacetate, 2-aminobenzothiazole, 2-benzoylhydradinobenzothiazole, and the like. Two or more of these compounds can used in combination.

Examples of the electron donative precursors used in the present invention include: triarylmethane compounds, diphenylmethane compounds, thiazine compounds, xanthene compounds, and spiropyrane compounds. Specifically, triarylmethane compounds and xanthene compounds are useful because they can produce high color-developing densities. These compounds include 3,3-bis (p-dimethylaminophenyl)-6-dimethylaminophthalide (i.e., crystal violet lactone), 3,3-bis (p-dimethylamino) phthalide, 3-(p-dimethylaminophenyl)-3-(1,3-dimethylindole-3-yl) phthalide, 3-(p-dimethylaminophenyl)-3-(2-methylindole-3-yl) phthalide, 3-(o-methyl-p-diethylaminophenyl)-3-(2-methylindole-3-yl) phthalide, 4,4'-bis (dimethylamino) benzhydrinebenzyl ether, N-halophenylleukoauramine, N-2,4,5-trichlorophenylleukoauramine, rhodamine-B-anilinolactam, rhodamine (p-nitroanilino) lactam, rhodamine-B-(p-chloroanilino) lactam, 2-benzilamino-6-diethylaminofluoran, 2-anilino-6-diethylaminofluoran, 2-anilino-3-methyl-6-diethylaminofluoran, 2-anilino-3-methyl-6-cyclohexylmethylaminofluoran, 2-anilino-3-methyl-6-isoamylethylaminofluoran, 2-(o-chloroanilino)-6-diethylaminofluoran, 2-octylamino-6-diethylaminofluoran, 2-ethoxyethylamino-3-chloro-2-diethylaminofluoran, 2-anilino-3-chloro-6-diethylaminofluoran, benzoylleukomethylene blue, p-nitrobenzilleukomethylene blue, 3-methyl-spiro-dinaphtopyran, 3-ethyl-spiro-dinaphtopyran, 3,3'-dichloro-spiro-dinaphtopyran, 3-benzilspirodinaphtopyran, and 3-propyl-spiro-dibenzopyran.

Examples of the electron acceptive compounds include phenol derivatives, salicylic acid derivatives, and hydroxy benzoic ester. Bisphenols and hydroxy benzoic esters are particularly preferable. Examples of these compounds include 2,2-bis (p-hydroxyphenyl) propane (i.e., bisphenol A), 4,4'-(p-phenylenediisopropylidene) diphenol (i.e., bisphenol P), 2,2-bis (p-hydroxyphenyl) pentane, 2,2-bis (p-hydroxyphenyl) ethane, 2,2-bis (p-hydroxyphenyl) butane, 2,2-bis (4'-hydroxy-3',5'-dichlorophenyl) propane, 1,1-(p-hydroxyphenyl) cyclohexane, 1,1-(p-hydroxyphenyl) propane, 1,1-(p-hydroxyphenyl) pentane, 1,1-(p-hydroxyphenyl)-2-ethylhexane, 3,5-di(α-methylbenzil) salicylic acid and its polyvalent metallic salts, 3,5-di(tert-butyl)-salicylic acid and its polyvalent metallic salts, 3-α,α-dimethylbenzilsalicylic acid and its polyvalent metallic salts, butyl p-hydroxybenzoate, benzil p-hydroxybenzoate, 2-ethylhexyl p-hydroxybenzoate, and p-phenylphenol, p-cumylphenol.

As sensitizers, low melting point organic compounds which include, in an appropriate amount, aromatic groups and polar groups in a molecule are preferable. Examples of such sensitizers include benzil p-benziloxybenzoate, α-naphthylbenzil ether, β-naphthylbenzil ether, phenyl β-naphthoate, phenyl α-hydroxy-β-naphthoate, β-naphthol-(p-chlorobenzil) ether, 1,4-butanediolphenyl ether, 1,4-butanediol-p-methylphenyl ether, 1,4-butanediol-p-ethylphenylether, 1,4-butanediol-m-methylphenylether, 1-phenoxy-2-(p-tolyloxy) ethane, 1-phenoxy-2-(p-ethylphenoxy) ethane, 1-phenoxy-2-(p-chlorophenoxy) ethane, and p-benzilbiphenyl.

In the present invention, the methods of using the above-described diazonium salt compounds, the couplers which react with the diazonium salt compounds so as to develop color, the basic substances, the electron donative colorless dyes, the electron acceptive compounds, and the sensitizers are not particularly limited. Namely, there are employed methods in which these substances are (1) solidly dispersed, (2) emulsified and dispersed, (3) polymer dispersed, (4) latex dispersed, (5) encapsulated in a microcapsule, and the like. However, among these methods, particularly from a storage point of view, a method in which the substances are encapsulated in microcapsules is preferable. In the color-developing system using the reaction of the diazonium salt compound and the couplers, diazonium salt compounds encapsulated in microcapsules are preferable. In the color-developing system using the reaction of the electron donative colorless dyes and the electron acceptive compounds, the electron donative colorless dyes encapsulated in microcapsules are preferable.

As a method of producing microcapsules, a conventionally known method can be used. Namely, color-developing agents, additives, and a precursor for a microcapsule wall are dissolved in organic solvent that is difficult to dissolve in water, or insoluble in water. The resultant solution is added to a water-soluble high polymer aqueous solution, emulsified by means of a homogenizer or the like, and the temperature thereof is raised. The high polymer substance for the microcapsule walls can be prepared by forming wall films at the interface of the oil droplets and water by heating.

Examples of the aforementioned organic solvents include low boiling point co-solvents such as acetic ester, methylenechloride, and cyclohexanone and/or phosphate ester, phthalate ester, acrylate ester, methacrylate ester, other carboxylilc acid ester, fatty acid amide, alkylated biphenyl, alkylated terphenyl, alkylated naphthalene, diarylethane, chlorinated paraffin, alcohols, phenols, ethers, monolefines, epoxys, and the like. Specific examples of such compounds include high boiling point oils such as tricresyl phosphate, trioctyl phosphate, octyldiphenyl phosphate, tricyclohexyl phosphate, dibutyl phthalate, dioctyl phthalate, dilauryl phthalate, dicyclohexyl phthalate, olefinic acid butyl, diethyleneglycolebenzoate, dioctyl sebacate, dibutyl sebacate, dioctyl adipate, trioctyl trimellitate, acetyltriethyl citrate, octyl maleate, dibutyl maleate, isoamylbiphenyl, chlorinated paraffin, diisopropylnaphthalene, 1,1'-ditolyethane, 2,4-ditertiaryamylphenol, N,N'-dibutyl-2-buthoxy-5-tertiaryoctylaniline, 2-ethylhexyl hydroxybenzonate, and polyethyleneglycole. However, among these compounds, it is particularly preferable to use alcohols, phosphoric esters, carboxylic acid esters, alkylated biphenyl, alkylated terphenyl, alkylated naphthalene, and diarylethane. Further, carbonization inhibitors such as hindered phenol and hindered amine can be added to the aforementioned high boiling point oils. Moreover, it is particularly preferable to use oils having unsaturated fatty acid such as α-methylstyrenedimer. As the α-methylstyrenedimer, for example, MSD100 (manufactured by Mitsui Toatsu Co., Ltd.) can be used.

As a water-soluble high polymer, a water-soluble high polymer such as polyvinyl alcohol is used. However, an emulsion or latex having a hydrophobic high polymer can be used together with this compound. Examples of such water-soluble high polymers include polyvinyl alcohol, silanol denatured polyvinyl alcohol, carboxy denatured polyvinyl alcohol, amino denatured polyvinyl alcohol, itaconic acid denatured polyvinyl alcohol, styrene-maleic anhydride copolymer, butadiene-maleic anhydride copolymer, ethylene-maleic anhydride copolymer, isobutylene-maleic anhydride copolymer, polyacrylamide, polystyrenesulfonic acid, polyvinylpyrolidone, ethylene-acrylic acid copolymer, and gelatin. Among these, carboxy denatured polyvinyl alcohol, and acylated gelatin (e.g., gelatin phthalate) are particularly preferable. Examples of hydrophobic high polymer emulsions or latexes include styrene-butadiene copolymer, carboxy denatured styrene-butadiene copolymer, and acrylonitrile-butadiene copolymer. In this case, conventionally known surfactants can be added as needed.

Specific examples of high polymer compounds for forming microcapsule wall films include polyurethane resin, polyurea resin, polyamide resin, polyester resin, polycarbonate resin, aminoaldehyde resin, melamine resin, polystyrene resin, styrene-acrylate copolymer resin, styrene-methacrylate copolymer resin, gelatin, and polyvinyl alcohol. Among these, as a wall agent, particularly preferable is a microcapsule having a wall film which consists of polyurethane or polyurea resin.

A precursor for a microcapsule wall which consists of polyurethane or polyurea resin such as polyvalent isocyanate or the like is mixed into core substances to be encapsulated, and is emulsified in a water-soluble high polymer aqueous solution such as polyvinyl alcohol or the like. A microcapsule having a wall film can be prepared through the reaction for forming a high polymer at the interface of the oil droplets and water under heating.

A portion of specific examples of polyvalent isocyanate compounds are given below. For example, diisocyanates such as m-phenylenediisocyanate, p-phenylenediisocyanate, 2,6-trilenediisocyanate, 2,4-trilenediisocyanate, naphthalene-1,4-diisocyanate, diphenylmethane-4,4'-diisocyanate, 3,3'-diphenylmethane-4,4'-diisocyanate, xylene-1,4-diisocyanate, 4,4'-diphenylpropanediisocyanate, trimethylenediisocyanate, hexamethylenediisocyanate, propylene-1,2-diisocyanate, butylene-1,2-diisocyanate, cyclohexylene-1,2-diisocyanate, and cyclohexylene-1,4-diisocyanate; triisocyanates such as 4,4',4"-triphenylmethanetriisocyanate and toluene-2,4,6-triisocyanate; tetraisocyanates such as 4,4'-dimethyldiphenylmethane-2,2' and 5,5'-tetraisocyanate; and isocyanate prepolymers such as an adduct of hexamethylenediisocyanate and trimethylolpropane, an adduct of 2,4-tolylenediisocyanate and trimethylolpropane, an adduct of xylylenediisociatante and trimethylolpropane; and an adduct of tolylenediisocyanate and hexantriol. Two or more of the aforementioned compounds can be mixed as needed. Among these, particularly preferable is a compound having three or more of isocyanate groups in a molecule.

In the method of preparing microcapsules, as an organic solvent for dissolving color-developing agents, additives, and a precursor for a microcapsule wall, the above-listed oils used in the emulsion dispersion can be used. Further, the same applies for the water-soluble high polymers.

Preferably, a particle diameter of each of the microcapsules ranges from 0.1 to 1.0 $\mu$m, and more preferably, from 0.2 to 0.7 $\mu$m.

In the present invention, a multicolor heat-sensitive recording material may be obtained by laminating the above-described heat-sensitive recording layers and having the hue of each heat-sensitive recording layer be different from each other. The layer structure is not particularly limited. However, a multicolor heat-sensitive recording material comprising two heat-sensitive recording layers which respectively contain different diazonium salt compounds having different absorption wavelengths and corresponding couplers which react with the diazonium salt compounds through the application of heat to thereby develop different hues and a heat-sensitive recording layer which contains an electron donative colorless dye and an electron acceptive compound is preferable. Further, a multicolor heat-sensitive recording material preferably comprises three heat-sensitive recording layers which respectively contain different diazonium salt compounds having different absorption wavelengths and corresponding couplers which react with the diazonium salt compounds through application of heat to thereby develop different hues is also preferable. The latter is particularly preferable.

Namely, the multicolor heat-sensitive recording layer preferably comprises a first heat-sensitive recording layer which is provided on a support and contains an electron donative colorless dye and an electron acceptive compound or a diazonium salt compound having a maximum absorption wavelength of 340 nm or less and a coupler which reacts with the diazonium salt compound through the application of heat to thereby develop color, a second heat-sensitive recording layer which contains a diazonium salt compound having a maximum absorption wavelength of 360±20 nm and a coupler which reacts with the diazonium salt compound through the application of heat to thereby develop color, and a third heat-sensitive recording layer which contains a diazonium salt compound having a maximum absorption wavelengh of 400±20 nm and a coupler which reacts with the diazonium salt compound through the application of heat to thereby develop color. In this example, the hue to be developed in each heat-sensitive recording layer may be selected so as to be one of the three primary colors in a subtractive color process, i.e., yellow, magenta, cyan, thereby allowing a full-color image to be recorded. An image is recorded on this multicolor heat-sensitive recording material in the following manner. First, the third heat-sensitive recording layer is heated so that the diazonium salt compound and the coupler contained therein develop color. Next, the unreacted diazonium salt compound contained in the third heat-sensitive recording layer is decomposed by irradiation with light having a wavelength of 400±20 nm. Subsequently, the second heat-sensitive recording layer is sufficiently heated so that the diazonium salt compound and the coupler contained therein develop color. At this time, the third heat-sensitive recording layer is also intensely heated but does not develop color any more since the diazonium salt compound contained in the third heat-sensitive recording layer has already decomposed and thus has lost its color-developing capability. Further, the multicolor heat-sensitive recording layer is irradiated with light having a wavelength of 360±20 nm so as to decompose the diazonium salt compound contained in the second heat-sensitive recording layer. Lastly, the first heat-sensitive recording layer is sufficiently heated, thereby causing the first heat-sensitive recording layer to develop color. At this time, the third and second heat-sensitive recording layers are also intensively heated but do not develop color any more since the diazonium salt compounds contained in the third and second heat-sensitive recording layers are already decomposed and thus have lost their color-developing capability.

In order to improve further the light-fastness of the heat-sensitive recording material of the present invention, the below-described known antioxidants can be used. Such antioxidants are disclosed, for example, in European Patent Laid-Open Nos. 310551, 310552, 459416, 223739, 309402, and 309401, German Patent Laid-Open No. 3435443, U. S. Pat. Nos. 4814262 and 4980275, JP-A Nos. 3-121449, 2-262654, 2-71262, 63-163351, 54-48535, 5-61166, 5-119449, 63-113536, and 62-262047.

Specific examples of such antioxidants include:

Q-1

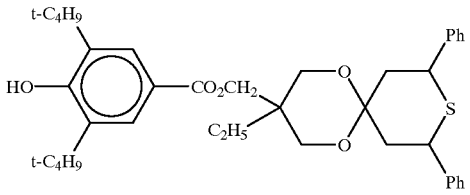

-continued
Q-2
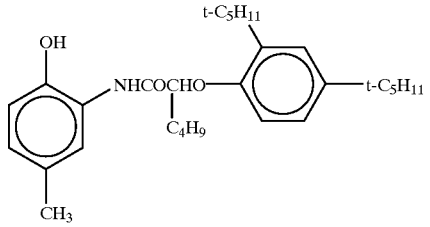
Q-3
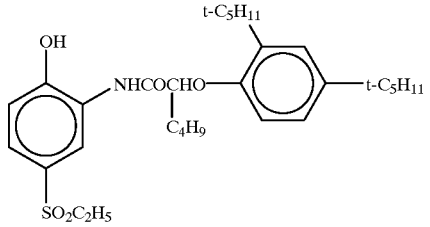
Q-4
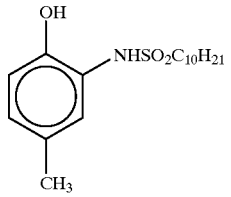
Q-5
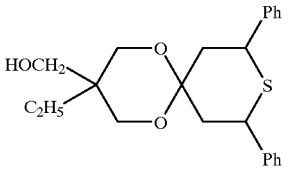
Q-6
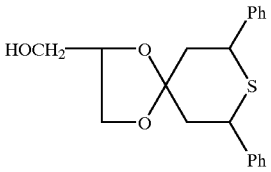
Q-7
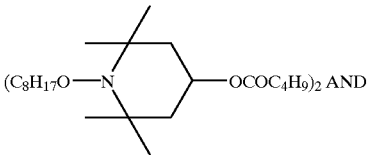
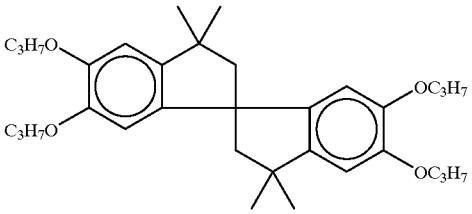
Q-8
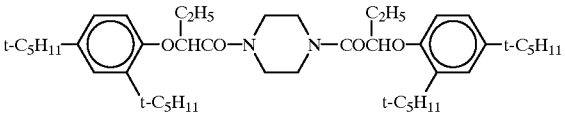
-continued
Q-9
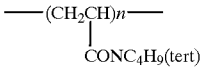
Q-10
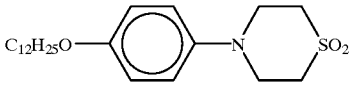
Q-11
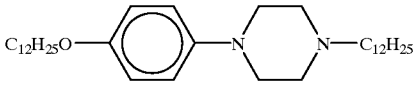
Q-12
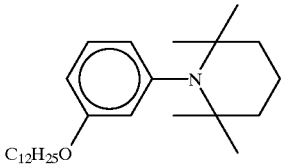
Q-13
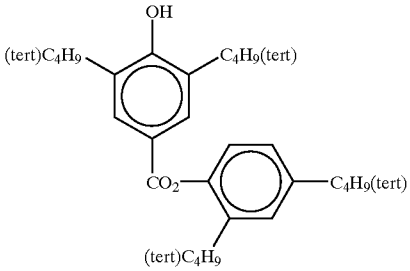
Q-14
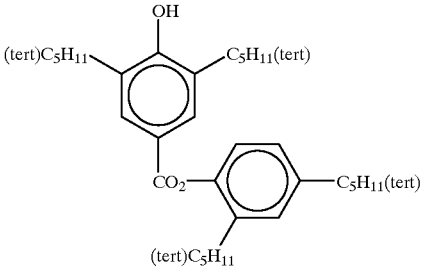
Q-15
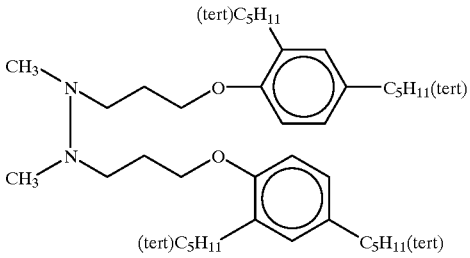
Q-16
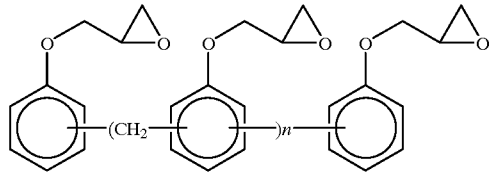

-continued

Q-17

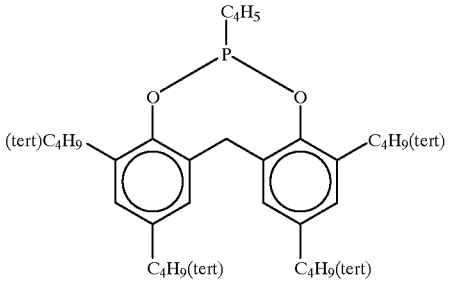

Q-18

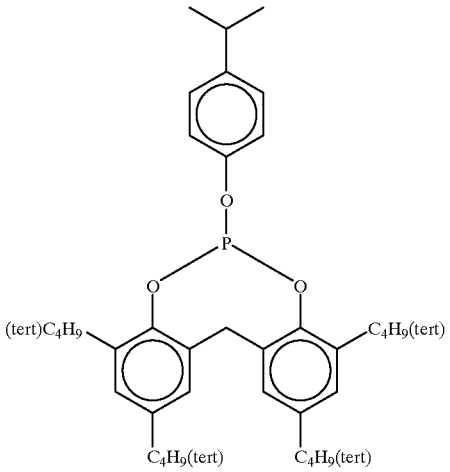

Q-19

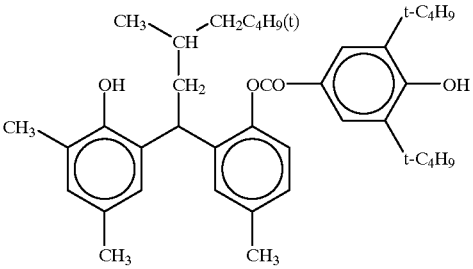

Q-20

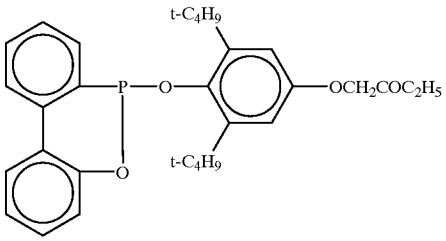

Q-21

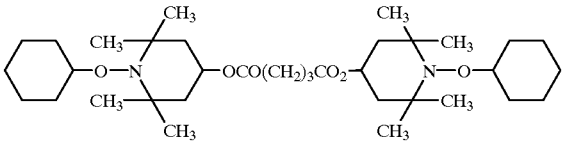

-continued

Q-22

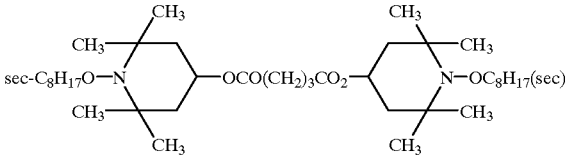

Q-23

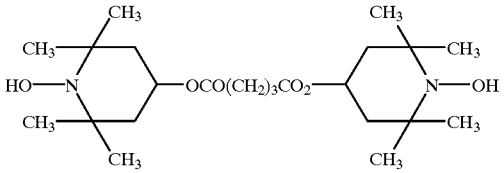

Q-24

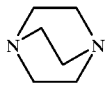

Q-25

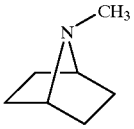

Q-26

$(C_{14}H_{29}OCOCH_2CH_2)_2S$

Q-27

$(C_{18}H_{37}OCOCH_2CH_2)_2S$

Q-28

$(C_{12}H_{25}SCH_2CH_2CO_2CH_2)_4C$

It is also effective to use various additives which are already known as heat-sensitive recording materials and a pressure-sensitive recording material for the heat-sensitive recording layer of the present invention. These antioxidants are partially disclosed in JP-A Nos. 60-125470, 60-125471, 60-125472, 60-287485, 60-287486, 60-287487, 62-146680, 60-287488, 62-282885, 63-89877, 63-88380, 63-088381, 01-239282, 04-291685, 04-291684, 05-188687, 05-188686, 05-110490, 05-1108437, 05-170361, 63-203372, 63-224989, 63-267594, 63-182484, 60-107384, 60-107383, 61-160287, 61-185483, 61-211079, 63-251282, 63-051174, 48-043294, and 48-033212.

Specific examples of these include 6-ethoxy-1-phenyl-2,2,4-trimethyl-1,2-dihydroquinoline, 6-ethoxy-1-octyl-2,2,4-trimethyl-1,2-dihydroquinoline, 6-ethoxy-1-phenyl-2,2,4-trimethyl-1,2,3,4-tetrahydroquinoline, 6-ethoxy-1-octyl-2,2,4-trimethyl-1,2,3,4- tetrahydroquinoline, nickel cyclohexanate, 2,2-bis-4-hydroxyphenylpropane, 1,1-bis-4-hydroxyphenyl-2-ethylhexane, 2-methyl-4-methoxydiphenylamine, 1-methyl-2-phenylindole or the below listed compounds.

Q-29
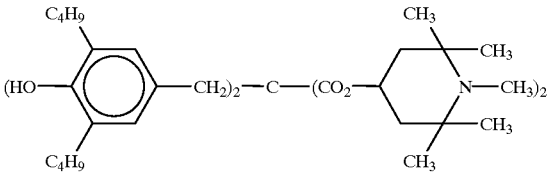
Q-30
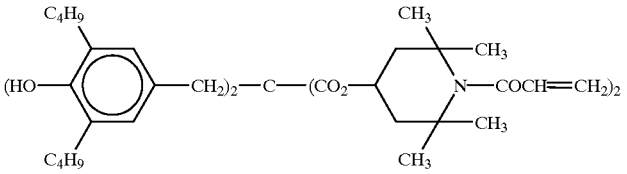
Q-31
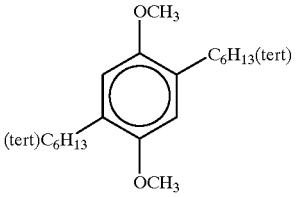
Q-32
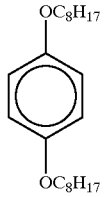
Q-33
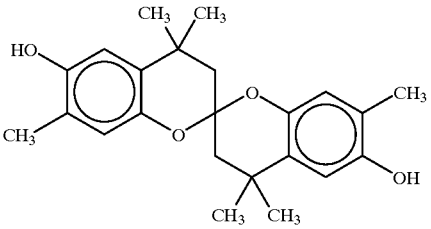
Q-34
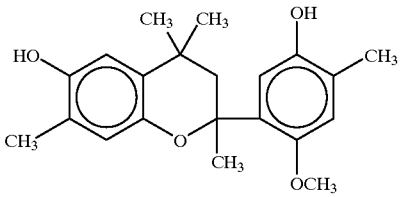
Q-35
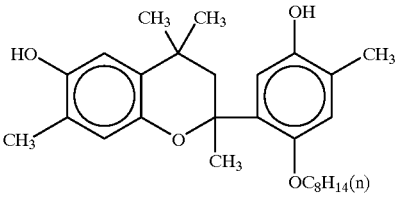
Q-36
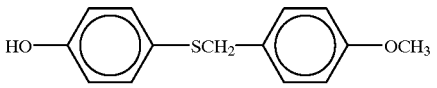
Q-37
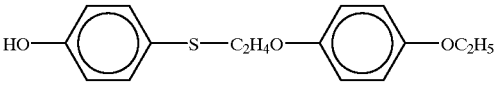
Q-38
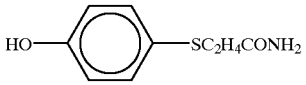
Q-39
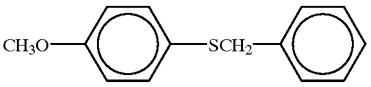
Q-40
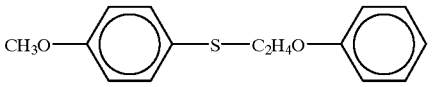
Q-41
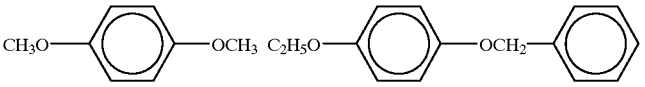
Q-42
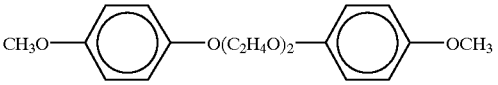
Q-43
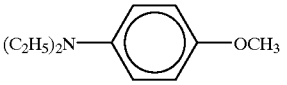

-continued
Q-44
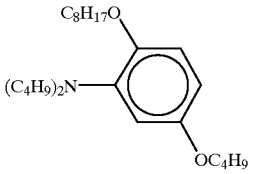
Q-45
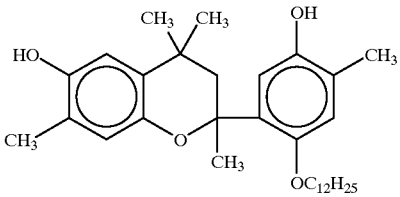
AND
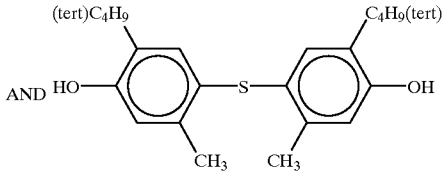
ARE USED IN COMBINATION
Q-46
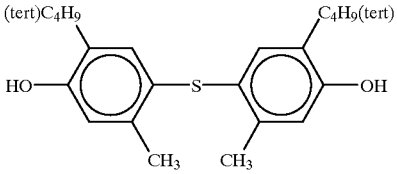
AND HYDROQUINONEETHER
ARE USED IN COMBINATION
Q-47
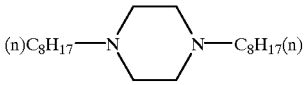
Q-48
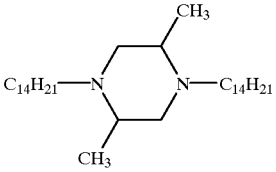
Q-49
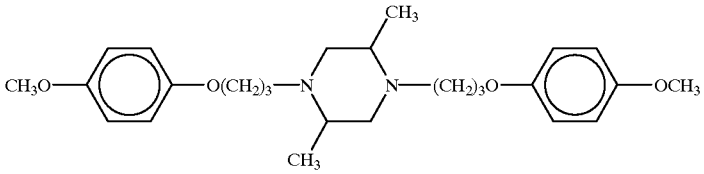
Q-50
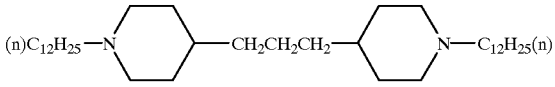
Q-51
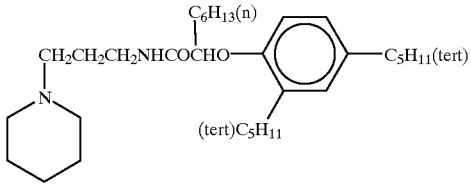
Q-52
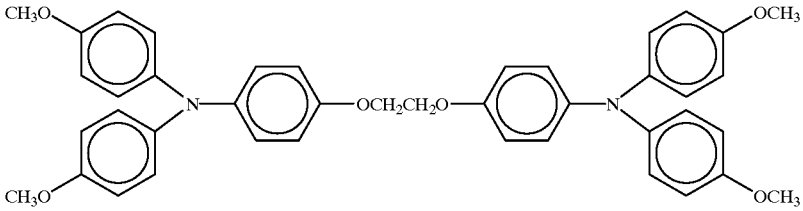

-continued

Q-53

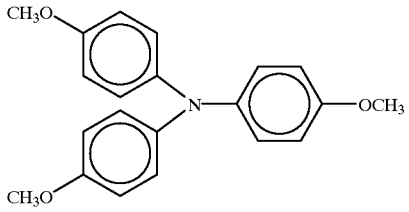

Q-54

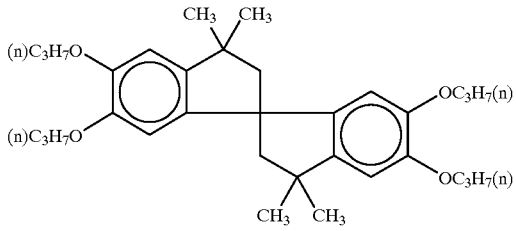

Q-55

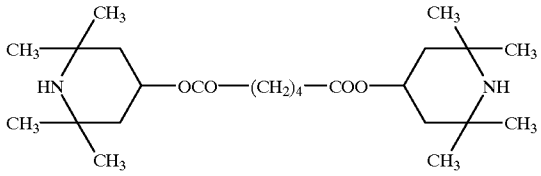

Q-56

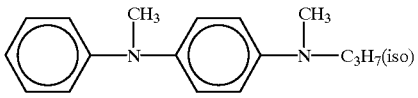

Q-57

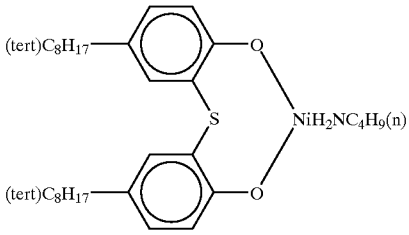

Q-58

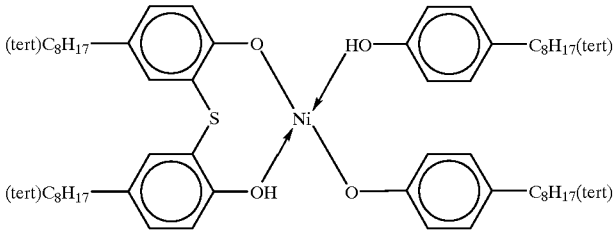

These antioxidants can be added to a heat-sensitive recording layer or an intermediate layer, a light transmittance adjusting layer, and a protective layer. When these antioxidants are used in combination, examples of these antioxidants used in combination include Examples (Q-7), (Q-45), (Q-46) or the compound (Q-10) and the compound (Q-13).

As the support used in the present invention, plastic film, paper, plastic resin-laminated paper, synthetic paper, or the like can be used.

In the present invention, if heat-sensitive recording layers having different hues are laminated, it is possible to provide an intermediate layer between the heat-sensitive recording layers in order to prevent color mixing or the like. If paper such as laminating paper having a high transmittance of $O_2$is used as a support, it is possible to use an undercoat layer as a Low oxygen peameability layer in order to improve light-fastness. A water-soluble high polymer compound is used for an intermediate layer or an undercoat layer. Examples of these compounds include polyvinylalcohol, denatured polyvinylalcohol, methylcellulose, polystyrene-sulfonic acid sodium, styrene-maleic acid copolymer, and gelatin.

In order to prevent color mixing and to improve light-fastness in a particularly thin intermediate layer or undercoat layer, it is effective to contain therein a swelling inorganic layer compound which is disclosed in Japanese Patent Application Laid Open No. 7-113825.

In the aforementioned examples, particularly a description of the full color heat-sensitive recording material has been given. Due to the necessity of color discrimination through the application of heat for the full color heat-sensitive recording material, the images must be printed at a high temperature; thus, it is particularly preferable to provide the protective layer of the present invention for the full color heat-sensitive recording material. However, the heat-sensitive recording material of the present invention may use a heat-sensitive recording material having a mono color heat-sensitive recording layer.

The mono color heat-sensitive recording layer contains at least a substantially colorless color-developing compound A, and a substantially colorless color-developing compound B which reacts with the color-developing compound A to thereby develop color. The color-developing compound A and the color-developing compound B which are used in the present invention are compounds which mutually generate a color-developing reaction by contacting with each other.

Examples 1) to 13) of combinations of such compounds are described below:

1) a combination of diazo compounds that are decomposed by light and couplers;

2) a combination of electron donative dye precursors and electron acceptive compounds;

3) a combination of organometallic salts such as silver behenate and silver stearate, and reductants such as protocatechuic acid, spiroindan, and hydroquinone;

4) a combination of long-chain fatty acid salts such as ferric stearate and ferric myristylate and phenols such as tannic acid, gallic acid and ammonium salycylate;

5) a combination of organic acid heavy metal salts such as nickel, cobalt, zinc, copper, iron, mercury, and silver salts of acetic acid, stearic acid, and palmitic acid either with alkaline earth metal sulfides such as calcium sulfide, strontium sulfide, and potassium sulfide, or with organic chelates such as s-diphenylcarbazide and diphenylcarbazone;

6) a combination of heavy metal sulfates such as sulfates of silver, zinc, mercury, and sodium, and sulfur compounds such as Na-tetrathionate, sodium thiosulfate and thiourea;

7) a combination of fatty acid ferric salts such as ferric stearate, and aromatic polyhydroxy compounds such as 3,4-hydroxytetraphenylmethane;

8) a combination of organic acid metallic salts such as oxalate and mercury oxalate, and organic polyhydroxy compounds such as polyhydroxyalcohol, glycerin, and glycol;

9) a combination of fatty acid ferric salts such as ferric pelargonate and ferric laurate, and thiocetylcarbamide or isothiocetylcarbamide derivatives;

10) a combination of organic acid lead salts such as lead caprate, lead pelargonate, and lead behenate, and thiourea derivatives such as ethylenethiourea, and N-dodecylthiourea;

11) a combination of higher fatty acid heavy metal salts such as ferric stearate and cupric stearate and zinc dialkylditiocarbamate.

12) a combination such as of resorcine and nitoroso compounds for forming oxazine dye; and 13) a combination of formazan compounds and reductants and/or metallic salts.

Among these combinations, in the present invention, 1) the combination of photodecompositive diazo compounds and couplers, 2) the combination of electron donative dye precursors and electron acceptive compounds, and 3) the combination of organometallic salts and reductants are preferable, the combinations 1) and 2) are more preferable, and the combination 1) is particularly preferable.

In the case of a wax such as amino denatured silicon oil which has a large interaction with a heat-sensitive recording material and which is not likely to become fused can be used in combination in the present invention. Accordingly, more excellent printing properties, running characteristics, and glossiness can be obtained. Preferably, the amount used of the amino denatured silicon oil is less than or equal to 0.05 $g/m^2$, and more preferably, less than or equal to 0.02 $g/m^2$.

EXAMPLES

The present invention will next be described by way of examples in more detail, which should not be construed as limiting the invention. Further, the term "parts" means "weight by parts" as far as it is not stipulated otherwise.

Example 1

(1) Manufacturing of support

A wooden pulp that is LBKP (hard wood bleached pulp) (100 parts by weight) was beaten by a double disk refiner to obtain a Canadian freeness standard of 300 cc or less. To the obtained pulp were added epoxy behenic acid amide (0.5 parts by weight), anionpolyacryl amide (1.0 parts by weight), polyamidepolyamine epichlorohydrine (0.1 parts by weight), and cationic polyacrylamide (0.5 parts by weight) at an absolute dry weight ratio. Untreated paper was made at a basis weight of 100 $g/m^2$ by using an elongated steel paper machine. The surface of the obtained untreated paper was sized by polyvinyl alcohol at an absolute dry weight ratio of 1.0 $g/m^2$ and was subjected to a calender process so as to obtain a density of 1.0.

After the wire surface (reverse surface) of the untreated paper thus obtained was subjected to a corona discharge process, the untreated paper was coated with high density polyethylene by a melting extruder so as to form a resin layer which was formed by a mat surface and which had a thickness of 30 $\mu$m (this surface is called a "reverse surface"). After the polyethylene coated surface of this reverse surface was subjected to a corona discharge process, as an antistatic agent, aluminum oxide (Aluminazol 100 manufactured by Nissan Chemical Industries Co., Ltd.) and silicon dioxide (Snowtex O manufactured by Nissan Chemical Industries Co., Ltd.) were dispersed in water at a weight ratio of 1:2, and the solution thus obtained was coated on the layer in an amount of 0.2 $g/m^2$ after drying (this is called a reverse laminated PE product).

After the felt surface (obverse surface) of the untreated paper was subjected to a corona discharge process, the untreated paper was coated with low density polyethylene which contains 10 wt. % of titanium dioxide and a trace amount of ultramarine blue by a melting extruder so as to form a resin layer which was formed by a glossy surface and which has a thickness of 40 $\mu$m (this surface is called an "obverse surface"). After the polyethylene coated surface of the obverse surface of the resin layer was subjected to a corona discharge process, the resin layer was coated with a gelatin undercoat solution in a dried amount of 0.1 $g/m^2$.

(2) Preparation of undercoat layer solution

A swelling synthetic mica ME100 (manufactured by Co-op Chemical Co., Ltd.) (2.5 parts by weight) and water (97.5 parts by weight) were mixed and dispersed by a dynamill. The resultant solution was added to a 5 wt. % aqueous gelatin solution (200 g) at a temperature of 40° C. and stirred for 30 minutes. To the resultant mixture was added the below-described 5 wt. % surfactant-1 (20 cc), to thereby obtain an undercoat layer solution.

Surfactant-1

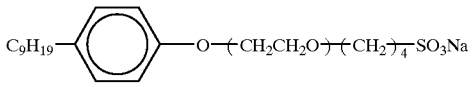

(3) Preparation of cyan heat-sensitive recording layer solution:

Preparation of capsule solution which contains electron donative dye precursor

1. Solution A

After 3-(o-methyl-p-dimethylaminophenyl)-3-(1'-ethyl-2'-methylindol-3-yl) phthalide (electron donative dye precursor) (5 parts by weight) was dissolved in ethyl acetate (20 parts by weight), to the resultant mixture was added alkylnaphthalene (high boiling point solution) (20 parts by weight), and the result was heated and uniformly mixed.

To the thus obtained solution was added 1:3 adduct of xylylene diisocyanate/trimethylolpropane (20 parts by weight). The resultant mixture was homogeneously stirred, providing solution A.

2. Solution B

A 6 wt. % aqueous phthalic gelatin solution (54 parts by weight) and a 2 wt. % aqueous sodium dodecyl sulfonate solution (2 parts by weight) were mixed, thus preparing solution B.

Solution A was added to solution B. The resultant mixture was emulsified and dispersed by using a homogenizer. The obtained emulsion and water (68 parts by weight) were uniformly mixed. The resultant mixture was heated to a temperature of 50° C. while being stirred, followed by an encapsulation reaction performed for 3 hours so as to obtain a capsule solution having a mean microcapsule diameter of 1.2 μm.

Preparation of developer emulsion dispersion 1,1-(p-hydroxyphenyl)-2-ethylhexane (developer) (2.5 parts by weight), tricresylphosphate (0.3 parts by weight), and diethyl maleate (0.1 parts by weight) were dissolved in ethyl acetate (10 parts by weight). The resultant solution was added to a mixed aqueous solution of a 6 wt. % aqueous gelatin solution (20 parts by weight) and a 2 wt. % aqueous sodium dodecylsulfonate solution (2 parts by weight). The resultant mixture was emulsified for 10 minutes through use of a homogenizer, to thereby obtain an emulsion dispersion.

Preparation of coating solution

A 40 wt. % SBR latex SN-307 (manufactured by Sumitomo ABC Latex Inc.) was added to a capsule solid matter of a capsule solution containing the above-prepared electron donative dye precursor. Thereafter, the capsule solution containing an electron donative dye precursor and a developer emulsion dispersion were mixed at a weight ratio of 1:4, to thereby obtain a cyan heat-sensitive recording layer solution.

(4) Preparation of magenta heat-sensitive recording layer solution

Preparation of capsule solution containing a diazo compound

After a diazo compound (1) represented by the structural formula described below (which is decomposed by light having a wavelength of 365 nm) (2.0 parts by weight) was dissolved in ethyl acetate (20 parts by weight), to the resultant solution was added alkylnaphthalene (20 parts by weight). The resultant mixture was heated and uniformly mixed. The obtained solution and 1:3 adduct of xylylene diisocyanate/trimethylolpropane (15 parts by weight) used as the capsule wall agent, were uniformly mixed to thereby obtain a diazo compound solution.

The obtained diazo compound solution was added to a mixed solution of a 6 wt. % aqueous phthalic gelatin solution (54 parts by weight) and a 2 wt. % aqueous sodium dodecylsulfonate (2 parts by weight). The resultant mixture was emulsified and dispersed through use of a homogenizer.

The obtained emulsion and water (68 parts by weight) were uniformly mixed. The resultant mixture was heated to a temperature of 40° C. while being stirred, which was followed by an encapsulation reaction performed for 3 hours so as to obtain a mean microcapsule diameter of 1.2 μm, thereby obtaining a capsule solution.

Diazo compound-(1)

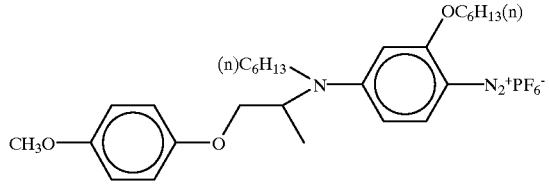

Preparation of coupler emulsion dispersion

A coupler (1) represented by the below-described structural formula (2 parts by weight), 1,2,3-triphenylguanidine (2 parts by weight), tricresylphosphate (0.3 parts by weight), and diethylmaleate (0.1 parts by weight) were dissolved in ethyl acetate (10 parts by weight). The obtained solution was added to a mixed aqueous solution of a 6 wt. % aqueous gelatin solution (20 parts by weight) and a 2 wt. % aqueous sodium dodecylsulfonate solution (2 parts by weight). The resultant mixture was emulsified for 10 minutes through use of a homogenizer, to thereby obtain an emulsion dispersion.

Coupler (1)

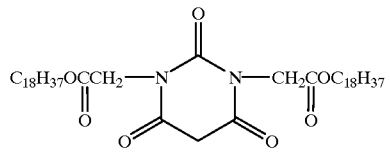

Preparation of coating solution

SBR latex SN-307 (manufactured by Sumitomo ABC Latex Inc.) in an amount that was 40 wt. % by weight of the capsule solid matter was added to a capsule solution containing the above-prepared electron donative dye precursor. Thereafter, the capsule solution and a developer emulsion dispersion were mixed at a weight ratio of 3:2, to thereby obtain a magenta heat-sensitive recording layer solution.

(5) Preparation of yellow heat-sensitive recording layer solution

Preparation of capsule solution containing a diazo compound 2,5-dibutoxy-4-tolylthiobenzene diazonium hexafluorophosphate (a diazo compound which is decomposed by light having a wavelength of 420 nm) (3.0 parts by weight) was dissolved in ethyl acetate (20 parts by weight). To the resultant solution was added alkylnaphthalen (20 parts by weight) as a high boiling point solvent. The resultant mixture was heated and uniformly mixed.

The obtained solution and 1:3 adduct of xylylene diisocyanate/trimethylolpropane (15 parts by weight) used as the material for the capsule wall, were uniformly mixed to thereby provide a diazo compound solution.

The obtained diazo compound solution was added to a mixed solution of a 6 wt. % aqueous phthalic gelatin solution (54 parts by weight) and an aqueous sodium dodecylsulfonate solution (2 parts by weight). The resultant mixture was emulsified through use of a homogenizer.

The obtained emulsion dispersion and water (68 parts by weight) were uniformly mixed. The resultant mixture was heated to a temperature of 40° C. while being stirred, which was followed by an encapsulation reaction performed for 3 hours so as to obtain a mean microcapsule diameter of 1.3 μm, thereby obtaining a capsule solution.

Preparation of coupler emulsion dispersion 2-chloro-5-(3-(2,4-di-tert-pentyl) phenoxypropyl amino)-acetanilide (2 parts by weight), 1,2,3-triphenylguanidine (1 part by weight), tricresyl phosphate (0.3 parts by weight) and diethyl maleate (0.1 parts by weight) were dissolved in ethyl acetate (10 parts by weight). The resultant solution was added to a mixed aqueous solution of a 6 wt. % aqueous gelatin solution (20 parts by weight) and a 2 wt. % aqueous sodium dodecylsulfonate solution (2 parts by weight). The resultant mixture was emulsified for 10 minutes through use of a homogenizer, to thereby obtain an emulsion dispersion.

Preparation of coating solution

The above-prepared coupler emulsion dispersion and a capsule solution containing a diazo compound were mixed at a weight ratio of 3:2 so as to provide a yellow heat-sensitive recording layer solution.

(6) Preparation of intermediate layer coating solution

A 15 wt. % aqueous gelatin solution (#750 manufactured by Nitta gelatin K. K.) (10 parts by weight) and a 15 wt. % aqueous polyacrylic acid solution (Julimer-AC-10L manufactured by Japan Pure Medicine Co., Ltd.) (3 parts by weight) were uniformly mixed, to thereby obtain an intermediate layer solution.

(7) Preparation of light transmittance adjusting layer coating solution

A compound described below (1.5 parts by weight) and a compound R-6 as a reductant (0.5 parts by weight) and ethyl acetate (6.0 parts by weight) and tricresyl phosphate (0.8 parts by weight) were mixed and dissolved sufficiently. To the resultant solution were added xylylenediisocyanate/trimethylolpropane (75% ethyl acetate solution, TAKENATE D-110N manufactured by Takeda Chemical Industries, Ltd.) (3.0 parts by weight) as a capsule wall agent, and the resultant mixture was uniformly stirred. An 8 wt. % aqueous carboxy denatured polyvinylalcohol solution KL-318 (manufactured by Kuraray Co., Ltd.) (29.7 parts by weight) was added to the former solution. The resultant mixture was emulsified through the use of a homogenizer. The resultant emulsion was added to ion exchange water (40 parts by weight) and stirred for three hours at a temperature of 40° C. to thereby perform an encapsulation reaction. Thereafter, to the resultant solution was added ion exchange resin, Amberlite MB-03 (manufactured by Organo Corp.) (7.0 parts by weight). The resultant mixture was stirred for another hour. In this way, a light transmittance adjusting layer coating solution was obtained. The mean particle diameter of capsules was 0.35 $\mu$m.

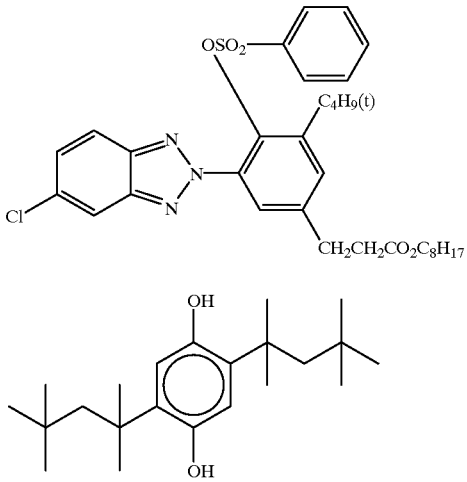

R-6

(8) Preparation of a protective layer solution

| | |
|---|---|
| Gelatin (15 wt. %) | 20 g |
| Water | 50 g |
| Simac US 450 (30 wt. %) (a silicon graft polymer manufactured by Toa Synthetic Co., Ltd.) | 25 g |
| Barifine BF21 dispersion (20 wt. %) (barium sulfate ultra-fine grains manufactured by Sakai Chemical Industry Co., Ltd.) | 7 g |
| Snowtex C (20 wt. %) (colloidal silica manufactured by Nissan Chemical Industries., Ltd.) | 5 g |
| Surfactant-1 (2 wt. %) | 3 ml |
| Surfactant-2 (5 wt. %) | 3 ml |
| Surfron S-131 (30 wt. %) (product name: fluoridated surfactant manufactured by Asahi Glass Co., Ltd.) | 0.5 ml |

Further, the aforementioned surfactant-2 is expressed by the following structural equation:

Surfactant-2

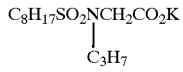

(9) Preparation of heat-sensitive recording material

The undercoat layer solution, the cyan heat-sensitive recording layer solution, the intermediate layer solution, the magenta heat-sensitive recording layer solution, the intermediate layer solution, the yellow heat-sensitive recording layer solution, the light transmittance adjusting layer solution, and the protective layer solution were coated on the aforementioned polyethylene laminated paper support in this order. After drying, the multicolor heat-sensitive recording material 100 was obtained.

Each of these coating solutions was applied in respective amounts as follows when converted to solid amounts after drying: in sequential order from the support, undercoat layer 1.0 g/m$^2$, cyan heat-sensitive recording layer 6.1 g/m$^2$, intermediate layer 1.0 g/m$^2$, magenta heat-sensitive recording layer 7.8 g/m$^2$, intermediate layer 1.0 g/m$^2$, yellow heat-sensitive recording layer 7.2 g/m$^2$, light transmittance adjusting layer 1.5 g/m$^2$, and protective layer 1.2 g/m$^2$.

Example 2

Preparation of a protective layer solution

| | |
|---|---|
| R2105 (10 wt. %) (silanol denatured polyvinylalcohol manufactured by Kuraray Co., Ltd.) | 30 g |
| Water | 52 g |
| Simac US 450 (30 wt. %) | 25 g |
| Barifine BF21 dispersion (20 wt. %) | 10 g |
| Snowtex C (20 wt. %) | 2 g |
| Surfactant-1 (2 wt. %) | 3 ml |
| Surfactant-2 (5 wt. %) | 3 ml |
| Surfron S131 (30 wt. %) | 0.5 g |

A heat-sensitive recording material was prepared in the same manner as in Example 1 except that the protective layer coating solution has the aforementioned composition.

Example 3

Preparation of a protective layer solution

| | |
|---|---|
| Gelatin (15 wt. %) | 20 g |
| Water | 25.7 g |
| X-22-8053 (25 wt. %) (silanol denatured polyvinylalcohol manufactured by Shinnetsu Chemical Co., Ltd.) | 33 g |
| Barifine BF20 dispersion (20 wt. %) | 10 g |
| Zinc stearic acid dispersion (20 wt. %) | 5 g |
| Surfactant-1 (2 wt. %) | 3 ml |
| Surfactant-2 (5 wt. %) | 3 ml |
| Surfron S131 (30 wt. %) | 0.5 g |

A heat-sensitive recording material was prepared in the same manner as in Example 1 except that the protective layer coating solution has the aforementioned composition.

Comparative Example 1

A heat-sensitive recording material was prepared in the same manner as in Example 2 except that in place of 30 g of R2105 (20 wt. %) and 25 g of Simac US 450 (30 wt. %) in Example 2, 63 g of R2105 (20 wt. %) was used.

Comparative Example 2

A heat-sensitive recording material was prepared in the same manner as in Example 1 except that in place of 10 g of Barifine BF21 dispersion (20 wt. %) in Example 1, kaolin (having a mean particle diameter of 1.3 $\mu$m) dispersion (20 wt. %) was used.

Comparative Example 3

Preparation of protective layer coating solution

| | |
|---|---|
| KL 318 (10 wt. %) (carboxy denatured polyvinyl alcohol manufactured by Kuraray Co., Ltd.) | 80 g |
| Water | 0.9 g |
| Surfactant-1 (2 wt. %) | 10 ml |
| Surfactant-2 (5 wt. %) | 5 ml |
| ME 313 (3 wt. %) (fluoridated oil manufactured by Daikin Inc.) | 20.0 g |
| Surfron S131 (30 wt. %) (fluoridated surfactant manufactured by Asahi Glass Co., Ltd.) | 1.1 g |
| Zinc stearic acid dispersion (20.5 wt. %) | 5.0 g |

A heat-sensitive recording material was prepared in the same manner as in Example 1 except that composition of the protective layer was modified, as described above.

Each of the heat-sensitive recording materials obtained in the above-described Examples and Comparative Examples was evaluated through the following evaluation method.

Evaluation Method

Feedability: 100 copies of paper were printed successively by a video/digital printer NC-5 manufactured by Fuji Photo Film Co., Ltd. At this time, the frequency at which feeding malfunctions such as simultaneous feeding of a plurality of papers occurred was counted. The smaller the frequency, the better the feedability.

Glossiness: gray printing was performed by a digital printer NC-300D manufactured by Fuji Photo Film Co., Ltd. A portion to be printed and a printed portion were measured at an incident angle of 20° by using a digital deformation glossimeter (UGV-5D manufactured by Suga Test Machine Co., Ltd.). The larger the value, the better the glossiness.

Method of measuring printing torque: A4-size sample paper was conveyed in a lengthwise direction under a head pressure of 7 kg/cm by using a platen roll having a rubber hardness of 60 degrees and a length of 30 cm, and a heat-sensitive recording head whose length is 30 cm, and gradation printing was performed from $D_{min}$ to $D_{max}$. Torque of the platen roll at that time was measured, the torque measured was converted to a kinetic frictional coefficient, and friction resistance was evaluated on the basis of the maximum value of kinetic frictional coefficient between the heat-sensitive recording head and the heat-sensitive recording material during printing.

Scratch resistance: the number of scratches formed on the printing surface of the heat-sensitive recording material printed by the video/digital printer NC-5 was evaluated visually. The following values are numbers of scratches in one print averaged from five prints.

The results of the evaluation are shown in Table 2.

TABLE 2

| | Feeding malfunction | Glossiness (%) | | Kinetic frictional | |
|---|---|---|---|---|---|
| | occurrence frequency | Portion to be printed | printed portion | coefficient with head | Scratch resistance |
| Example 1 | 0 | 32.5 | 45.8 | 0.13 | 0.5 |
| Example 2 | 0 | 20.9 | 35.2 | 0.18 | 1.3 |
| Example 3 | 0 | 30.1 | 46.5 | 0.09 | 0.8 |
| Comp. Example 1 | 2 | 21.8 | — | >0.3 | — |
| Comp. Example 2 | 0 | 9.8 | 26.8 | 0.11 | 0.7 |
| Comp. Example 3 | 19 | 22.3 | 20.3 | 0.28 | 5.9 |

In the heat-sensitive recording materials in the examples, as compared to Comparative Examples, feedability is excellent because all of the papers were fed. Further, glossiness was excellent, and friction resistance was also excellent because no friction was caused during printing between the heat-sensitive recording head and the heat-sensitive recording material. (If the friction between the heat-sensitive recording material and the heat-sensitive recording head is large, interface noise is caused during printing so that printing misalignment is thereby caused.) The number of scratches formed on the printing surface was extremely small.

Conversely, each of heat-sensitive recording materials prepared in Comparative Examples 1 and 3 did not contain a silicon denatured polymer so that kinetic friction of the heat-sensitive recording material with respect to the heat-sensitive recording head was large. In Comparative Example 1, it was impossible to print images on the heat-sensitive recording material. In Comparative Example 3, due to sticking, decrease of glossiness on the printed surface of the heat-sensitive recording material was seen. Further, in Comparative Example 2 in which in place of the ultra-fine grains, pigments in general use and having a large particle size were used, decrease of glossiness of a portion to be printed on the heat-sensitive recording material was noticeable.

As described above, according to the present invention, it is possible to provide a heat-sensitive recording material which is excellent in transparency, glossiness, and light-fastness, and which is also excellent in scratch resistance because the heat-sensitive recording material has a protective layer which is excellent in friction resistance and lubricity with respect to a heat-sensitive recording head, thus preventing adhesion of the heat-sensitive recording material to the heat-sensitive recording head and deposition of foreign matters thereon.

What is claimed is:

1. A heat-sensitive recording material, comprising: a support, and a heat-sensitive recording layer and a protective layer which are provided on the support, wherein said protective layer contains at least a silicon denatured polymer and inorganic ultra-fine grains whose mean primary particle diameter is less than or equal to 0.1 $\mu$m.

2. A heat-sensitive recording material according to claim 1, wherein said silicon denatured polymer is a silicon graft polymer.

3. A heat-sensitive recording material according to claim 2, wherein said inorganic ultra-fine grains are of at least one selected from a group consisted of barium sulfate, zinc oxide, magnesium oxide, lead oxide, zirconium oxide, colloidal silica, and alumina.

4. A heat-sensitive recording material according to claim 3, wherein said inorganic ultra-fine grains are barium sulfate.

5. A heat-sensitive recording material according to claim 3, wherein said inorganic ultra-fine grains are alumina.

6. A heat-sensitive recording material according to claim 3, wherein said inorganic ultra-fine grains are colloidal silica.

7. A heat-sensitive recording material according to claim 3, wherein, as said inorganic ultra-fine grains, colloidal silica and inorganic ultra-fine grains of another type mixed in a ratio of 1:9 to 6:4 (colloidal silica to the inorganic ultra-fine grains of another type) by weight are used in combination.

8. A heat-sensitive recording material according to claim 3, wherein said protective layer is formed by using in addition another water-soluble binder.

9. A heat-sensitive recording material according to claim 8, wherein said another water-soluble binder is gelatin.

10. A heat-sensitive recording material according to claim 2, wherein said protective layer is formed by using in addition another water-soluble binder.

11. A heat-sensitive recording material according to claim 10, wherein said another water-soluble binder is gelatin.

12. A heat-sensitive recording material according to claim 1, wherein said inorganic ultra-fine grains are of at least one selected from a group consisted of barium sulfate, zinc oxide, magnesium oxide, lead oxide, zirconium oxide, colloidal silica, and alumina.

13. A heat-sensitive recording material according to claim 12, wherein said inorganic ultra-fine grains are barium sulfate.

14. A heat-sensitive recording material according to claim 12, wherein said inorganic ultra-fine grains are alumina.

15. A heat-sensitive recording material according to claim 12, wherein said inorganic ultra-fine grains are colloidal silica.

16. A heat-sensitive recording material according to claim 12, wherein, as said inorganic ultra-fine grains, colloidal silica and inorganic ultra-fine grains of another type mixed in a ratio of 1:9 to 6:4 (colloidal silica to the inorganic ultra-fine grains of another type) by weight are used in combination.

17. A heat-sensitive recording material according to claim 12, wherein said protective layer is formed by using in addition another water-soluble binder.

18. A heat-sensitive recording material according to claim 17, wherein said another water-soluble binder is gelatin.

19. A heat-sensitive recording material according to claim 1, wherein said protective layer is formed by using in addition another water-soluble binder.

20. A heat-sensitive recording material according to claim 19, wherein said another water-soluble binder is gelatin.

* * * * *